US012703940B2

(12) United States Patent
Kim

(10) Patent No.: US 12,703,940 B2
(45) Date of Patent: Aug. 11, 2026

(54) DRYER OPERATING METHOD

(71) Applicant: LG ELECTRONICS INC., Seoul (KR)

(72) Inventor: Yang Gyu Kim, Seoul (KR)

(73) Assignee: LG Electronics Inc., Socul (KR)

( * ) Notice: Subject to any disclaimer, the term of this patent is extended or adjusted under 35 U.S.C. 154(b) by 1084 days.

(21) Appl. No.: 17/788,631

(22) PCT Filed: Dec. 22, 2020

(86) PCT No.: PCT/KR2020/018941
§ 371 (c)(1),
(2) Date: Jun. 23, 2022

(87) PCT Pub. No.: WO2021/133041
PCT Pub. Date: Jul. 1, 2021

(65) Prior Publication Data

US 2023/0063185 A1 Mar. 2, 2023

(30) Foreign Application Priority Data

Dec. 24, 2019 (KR) ..... 10-2019-0173856
Feb. 6, 2020 (KR) ..... 10-2020-0014307
Feb. 6, 2020 (KR) ..... 10-2020-0014318

(51) Int. Cl.
*D06F 58/38* (2020.01)
*D06F 58/02* (2006.01)
(Continued)

(52) U.S. Cl.
CPC ..... *D06F 58/38* (2020.02); *D06F 58/02* (2013.01); *D06F 58/24* (2013.01); *D06F 58/26* (2013.01);
(Continued)

(58) Field of Classification Search
CPC ..... D06F 58/38; D06F 58/02; D06F 58/24; D06F 58/26; D06F 2105/28; D06F 2105/32; D06F 58/206; D06F 58/20; D06F 58/40
See application file for complete search history.

(56) References Cited

U.S. PATENT DOCUMENTS 5,566,555 A 10/1996 Hewitt
6,585,781 B1 7/2003 Roseen
(Continued)

FOREIGN PATENT DOCUMENTS

CN 101178210 A 5/2008
CN 105392937 A 3/2016
(Continued)

OTHER PUBLICATIONS

Office Action in Chinese Appln. No. 202080090282.2, mailed on Mar. 19, 2025, 20 pages (with English translation).
(Continued)

*Primary Examiner* — Jessica Yuen
(74) *Attorney, Agent, or Firm* — Fish & Richardson P.C.

(57) ABSTRACT

A dryer and a method for operating the dryer are useful in a 5G environment provided for the Internet of Things. The dryer includes a heating device, a tumbler connected to the exit of the heating device, a fan connected to the exit of the tumbler, a heat exchanger disposed in a flow line of a working fluid connected to the exit of the fan, and a compressor having an entrance connected to the flow line connected to the exit of the fan and an exit connected to the entrance of the heat exchanger. The method includes heating the working fluid using the heating device, reducing the pressure in the tumbler by discharging a portion of the working fluid in a circulation line to outside using the
(Continued)

compressor, drying an object to be dried received in the tumbler, and cooling the object to be dried.

17 Claims, 9 Drawing Sheets

(51) Int. Cl.

| | |
|---|---|
| ***D06F 58/24*** | (2006.01) |
| ***D06F 58/26*** | (2006.01) |
| ***D06F 105/28*** | (2020.01) |
| ***D06F 105/32*** | (2020.01) |

(52) U.S. Cl.
CPC ..... *D06F 2105/28* (2020.02); *D06F 2105/32* (2020.02)

(56) References Cited

U.S. PATENT DOCUMENTS

| | | | | |
|---|---|---|---|---|
| 8,650,770 | B1 | 2/2014 | Levy | |
| 2011/0198405 | A1* | 8/2011 | Krausch ..... | D06F 58/36 236/44 C |
| 2017/0145624 | A1 | 5/2017 | Dulberg et al. | |

FOREIGN PATENT DOCUMENTS

| | | | |
|---|---|---|---|
| DE | 60219356 | T2 | 12/2007 |
| EP | 1147252 | B1 | 8/2004 |
| JP | 2004-166744 | A | 6/2004 |
| JP | 2007-306960 | A | 11/2007 |
| JP | 2014023732 | | 2/2014 |
| KR | 10-1999-0001366 | A | 1/1999 |
| KR | 20040090051 | | 10/2004 |
| KR | 101119120 | | 3/2012 |
| KR | 10-1436754 | B1 | 9/2014 |
| KR | 10-2018-0014615 | A | 2/2018 |
| KR | 20180014615 | | 2/2018 |
| WO | 2001/11134 | A1 | 2/2001 |
| WO | WO2008138779 | | 11/2008 |
| WO | WO 2015/136393 | A1 | 9/2015 |

OTHER PUBLICATIONS

Office Action in Korean Appln. No. 10-2020-0014307, mailed on Nov. 14, 2024, 9 pages (with English translation).
Office Action in Korean Appln. No. 10-2020-0014318, mailed on Nov. 14, 2024, 10 pages (with English translation).
Extended European Search Report in European Appln. No. 20906890.7, mailed on Nov. 27, 2023, 8 pages.

* cited by examiner

DRYER OPERATING METHOD

CROSS-REFERENCE TO RELATED APPLICATIONS

This application is a National Phase Application under 35 U.S.C. § 371 of International Application No. PCT/KR2020/018941, filed on Dec. 22, 2020, which claims benefit to Korean Application No. 10-2010-0014318, filed Feb. 6, 2020, Korean Application No. 10-2020-0014307, filed on Feb. 6, 2020, and Korean Application No. 10-2019-0173856, filed on Dec. 24, 2019. The disclosures of the prior applications are incorporated by reference in their entirety.

TECHNICAL FIELD

The present disclosure relates to a dryer operating method, and more particularly to a dryer operating method capable of improving the efficiency and performance of a dryer.

BACKGROUND ART

The content described in this section simply provides background information related to embodiments, and does not constitute the related art.

A dryer is used to dry an object to be dried, such as laundry. A dryer may be categorized into a gas type, an electric-heating type, and a heat-pump type depending on the method of obtaining heat for heating an object to be dried.

The gas type is a type that heats an object to be dried using heat generated by burning combustible gas. The gas-type dryer has disadvantages in that the overall size thereof is large and the structure thereof is complicated in order to receive gas supplied from outside.

The electric-heating type is a type that heats an object to be dried using heat obtained from an electric heater. The electric-heating-type dryer has advantages in that the size thereof is small and the structure thereof is simple.

However, because the electric-heating-type dryer uses electricity, which is an expensive energy source, the same is disadvantageous from the aspect of costs and energy efficiency.

The heat-pump type is a type that heats an object to be dried using heat obtained by transferring heat from a low-temperature thermal reservoir to a high-temperature thermal reservoir using a compressor.

The heat-pump-type dryer may obtain heat using a compressor, and may use electricity to operate the compressor.

However, unlike the electric-heating type, which generates heat by converting electricity into heat, the heat-pump type obtains heat by collecting heat from a low-temperature thermal reservoir and transferring the same to a high-temperature thermal reservoir, and is thus advantageous in that less power is consumed than in the case of the electric-heating type.

The demand for an electric-heating-type dryer having an advantage of low power consumption is continually increasing, and accordingly, research and development related thereto is being actively carried out.

DISCLOSURE OF INVENTION

Technical Problem

An object of the present disclosure is to provide a dryer operating method capable of improving the efficiency and performance of a dryer.

An object of the present disclosure is to provide a dryer operating method capable of reducing initial heating to thus reduce power consumption.

An object of the present disclosure is to provide a dryer operating method for a dryer equipped with a gas-liquid separator.

An object of the present disclosure is to provide a dryer operating method capable of improving the heat exchange efficiency of a heat exchanger.

An object of the present disclosure is to provide a dryer operating method capable of effectively preventing condensed water from collecting in a heat exchanger.

An object of the present disclosure is to provide a dryer operating method for a dryer in which counter-flow heat exchange occurs in a heat exchanger in order to improve heat exchange efficiency.

An object of the present disclosure is to provide a dryer operating method for a dryer in which a heat exchanger and a compressor are connected to each other.

An object of the present disclosure is to provide a dryer operating method capable of increasing the temperature of a working fluid and the proportion of steam in the working fluid introduced into a compressor in order to improve the heat exchange efficiency of a heat exchanger.

Solution to Problem

In order to accomplish the above objects, a dryer according to an embodiment of the present disclosure may include a heating device, a tumbler connected to the exit of the heating device, a fan connected to the exit of the tumbler, a heat exchanger disposed in a flow line of a working fluid connected to the exit of the fan, and a compressor having an entrance connected to the flow line connected to the exit of the fan and an exit connected to the entrance of the heat exchanger.

A dryer operating method according to an embodiment of the present disclosure may include heating the working fluid using the heating device, reducing the pressure in the tumbler by discharging a portion of the working fluid in the circulation line to outside using the compressor, drying an object to be dried received in the tumbler, and cooling the object to be dried.

The dryer may further include an accommodation part configured to accommodate the heat exchanger therein. The accommodation part may be connected to the flow line connected to the exit of the fan, the flow line connected to the entrance of the heating device, and the flow line connected to the entrance of the compressor.

The dryer may further include a discharge valve connected to the exit of the heat exchanger.

The dryer operating method may further include opening the discharge valve when the pressure in the tumbler is reduced, and closing the discharge valve when the object to be dried received in the tumbler is dried.

The dryer may further include a discharge line connected to the exit of the heat exchanger and having the discharge valve disposed therein, and a regeneration line having one end branching from the discharge line and an opposite end connected to the circulation line.

The regeneration line may be connected to at least one of the flow line of the working fluid interconnecting the heating device and the tumbler, the flow line of the working fluid interconnecting the tumbler and the fan, the flow line of the working fluid connected to the exit of the fan, or the flow line of the working fluid connected to the entrance of the heating device.

The dryer may further include a control valve disposed in the regeneration line.

The dryer operating method may further include closing the control valve when the pressure in the tumbler is reduced, and opening the control valve when the object to be dried received in the tumbler is dried.

The dryer may further include a gas-liquid separator having an entrance connected to the exit of the heat exchanger and a gas exit connected to the regeneration line, a steam trap connected to the condensed water exit of the gas-liquid separator, a decompression device provided in at least one of the flow line interconnecting the exit of the heat exchanger and the entrance of the gas-liquid separator or the flow line interconnecting the gas exit of the gas-liquid separator and the discharge line, bypass lines, and bypass valves respectively disposed in the bypass lines. One of the bypass lines may have two ends connected to respective ends of the decompression device, and the remaining one of the bypass lines may have two ends connected to respective ends of the steam trap.

The dryer operating method may further include stopping operation of the heating device when the pressure in the tumbler is reduced.

The dryer operating method may further include introducing at least a portion of the working fluid discharged from the heat exchanger into the circulation line when the object to be dried received in the tumbler is dried.

The dryer operating method may further include stopping operation of the compressor when the object to be dried is cooled.

A dryer operating method according to an embodiment of the present disclosure may include heating the working fluid using the heating device, reducing the pressure in the tumbler by stopping operation of the heating device and discharging a portion of the working fluid in the circulation line to outside using the compressor, drying an object to be dried received in the tumbler, and cooling the object to be dried by stopping operation of the compressor.

In order to accomplish the above objects, a dryer according to an embodiment of the present disclosure may include a heating device, a tumbler having an entrance connected to the heating device, a fan connected to the exit of the tumbler, a heat exchanger disposed in a flow line of a working fluid connected to the exit of the fan, and a compressor having an entrance connected to the flow line of the working fluid connected to the exit of the fan and an exit connected to the entrance of the heat exchanger.

The heat exchanger may include a first inlet configured to receive the working fluid introduced thereinto from the compressor, and a first outlet configured to discharge the working fluid from the heat exchanger. The first inlet may be disposed at a higher position than the first outlet.

The heat exchanger may include a first header provided with the first inlet and disposed so as to have a longitudinal direction parallel to the upward-downward direction, a second header provided with the first outlet and disposed so as to have a longitudinal direction parallel to the upward-downward direction, and a plurality of first tubes disposed at predetermined intervals in the upward-downward direction. Each of the plurality of first tubes may have two ends respectively connected to the first header and the second header.

The first inlet may be formed in the upper end of the first header, and the first outlet may be formed in the lower end of the second header.

The first inlet may be formed in the side surface of the first header, and the first outlet may be formed in the lower end of the second header.

The first inlet may be formed in the upper portion of the side surface of the first header.

The first tubes may be disposed such that the longitudinal direction thereof intersects the longitudinal direction of the first header and the longitudinal direction of the second header.

The heat exchanger may include a plurality of second tubes disposed at predetermined intervals in the upward-downward direction, and a return band configured to interconnect the exit of one of the plurality of second tubes and the entrance of an adjacent one of the plurality of second tubes. The first inlet may be formed in one end of the second tube disposed at the uppermost position among the plurality of second tubes, and the first outlet may be formed in one end of the second tube disposed at the lowermost position among the plurality of second tubes.

The heat exchanger may be provided so as to have a single flow path by the return band connected to ends of the plurality of second tubes.

The heat exchanger may be formed in a zigzag shape in the upward-downward direction.

The second tubes may be disposed such that the longitudinal direction thereof intersects the upward-downward direction.

The dryer according to the embodiment of the present disclosure may be configured such that the flow direction of at least a portion of the working fluid flowing outside the heat exchanger and the flow direction of at least a portion of the working fluid flowing inside the heat exchanger are opposite each other.

The first inlet may be disposed further backwards than the first outlet based on the flow direction of the working fluid flowing outside the heat exchanger.

The dryer according to the embodiment of the present disclosure may further include an accommodation part configured to accommodate the heat exchanger therein and to allow the working fluid to flow therein. The accommodation part may include a second inlet and a second outlet, through which the working fluid flowing outside the heat exchanger is introduced into and discharged from the accommodation part. The second inlet may be disposed adjacent to the first outlet, and the second outlet may be disposed adjacent to the first inlet.

In order to accomplish the above objects, a dryer according to an embodiment of the present disclosure may include a tumbler, a fan connected to the exit of the tumbler, a heat exchanger disposed in a flow line of a working fluid connected to the exit of the fan, a compressor having an entrance connected to a circulation line of the working fluid connected to the exit of the fan and an exit connected to the entrance of the heat exchanger, and an extraction line interconnecting the circulation line and the entrance of the heat exchanger.

The extraction line may have an entrance disposed so as to face the working fluid flowing through the circulation line.

The dryer according to the embodiment of the present disclosure may further include an accommodation part configured to accommodate the heat exchanger therein and to allow the working fluid to flow therein, and the entrance of the extraction line may be disposed at the center portion of the cross-section of the accommodation part.

The working fluid may flow inside the accommodation part in a direction perpendicular to the cross-section of the accommodation part.

The extraction line may include a first pipe penetrating the wall of the accommodation part and having one end connected to the compressor and an opposite end disposed in the accommodation part, and a second pipe bent and extending from the opposite end of the first pipe and disposed such that at least a portion thereof has a longitudinal direction parallel to the flow direction of the working fluid in the accommodation part.

The entrance of the extraction line may be formed in an end of the second pipe.

A plurality of entrances of the extraction line may be provided at the center portion inside the accommodation part, and the entrances of the extraction line may be disposed so as to be symmetrical to each other.

The second pipe may include a header having one end connected to the first pipe, and a plurality of branch lines, each of which has one end connected to the header and an opposite end having therein the entrance of the extraction line.

The tumbler may be provided therein with a heating device for heating the object to be dried received therein.

The heating device may be disposed at a position adjacent to the inner surface of the tumbler.

The heating device may be configured as an electric induction heater.

At least part of the electric induction heater may be disposed on the inner surface of the tumbler in the circumferential direction.

The heating device may be configured as an infrared lamp, and at least one infrared lamp may be disposed outside the tumbler in the circumferential direction.

The dryer according to the embodiment of the present disclosure may further include a heater controller, which is electrically connected to the heating device, and a humidity sensor, which is electrically connected to the heater controller and is mounted in the tumbler to measure the humidity in the tumbler.

Advantageous Effects of Invention

According to embodiments of the present disclosure, since initial heating using the heating device and reduction of the pressure in the tumbler using the compressor are performed together, the proportion of steam in the circulation line may reach or exceed a predetermined value.

According to embodiments of the present disclosure, since power consumption by the heating device is reduced by greatly reducing initial heating using the heating device and steam required for operation of the dryer is obtained using the compressor, the efficiency of the dryer may be improved.

According to embodiments of the present disclosure, since only the fan is operated to cool the object to be dried without introducing outside air into the circulation line or operating the heating device and the compressor, it is possible to effectively prevent condensation of steam in the circulation line due to introduction of outside air in the cooling step.

According to embodiments of the present disclosure, since the structure of the dryer is simplified, it is possible to facilitate design of the dryer and to reduce the cost of manufacturing the dryer.

According to embodiments of the present disclosure, since the heating device and the compressor are not operated in the cooling step, power consumption may be reduced, and accordingly, the efficiency of the dryer may be improved.

According to embodiments of the present disclosure, since the first inlet is located at a higher position than the first outlet, condensed water generated in the pipe of the heat exchanger may be smoothly discharged outside the heat exchanger through the first outlet due to gravity. Accordingly, it is possible to effectively prevent condensed water from collecting in the heat exchanger.

According to embodiments of the present disclosure, the flow direction of the working fluid in the circulation line and the flow direction of the working fluid in the non-circulation line may be set so as to realize counter-flow heat exchange, in which the working fluids flowing in opposite directions exchange heat with each other.

Accordingly, the heat exchange efficiency of the heat exchanger may be improved compared to parallel-flow heat exchange, in which working fluids flowing in the same direction exchange heat with each other.

According to embodiments of the present disclosure, since the entrance of the extraction line is disposed so as to face the working fluid flowing through the circulation line, the amount of working fluid that is introduced into the compressor may increase, and accordingly, the heat exchange efficiency of the heat exchanger may increase.

According to embodiments of the present disclosure, since the entrance of the extraction line is disposed at the center portion of the cross-section of the accommodation part, at which the temperature of the working fluid and the proportion of steam therein are the highest, the heat content of the working fluid flowing into the compressor may increase compared to the case in which the entrance of the extraction line is disposed at the edge of the cross-section of the accommodation part.

According to embodiments of the present disclosure, the heat exchange efficiency of the heat exchanger may increase due to increase in the heat content of the working fluid flowing into the compressor.

According to embodiments of the present disclosure, since the heating device is provided in the tumbler in order to heat the inside of the tumbler, it is possible to obtain a large amount of steam in a short time period with a small amount of heat compared to the case in which the heating device is disposed at another position in the dryer.

According to embodiments of the present disclosure, even when the entrance of the extraction line is provided in plural, a portion of the working fluid that has a relatively high temperature and contains a relatively large amount of steam in the accommodation part may be introduced into the compressor through the entrances of the extraction line, and accordingly, the heat exchange efficiency of the heat exchanger may increase.

BRIEF DESCRIPTION OF DRAWINGS

The foregoing and other objects, features, and advantages of the invention, as well as the following detailed description of the embodiments, will be better understood when read in conjunction with the accompanying drawings. For the purpose of illustrating the invention, there is shown in the drawings an exemplary embodiment that is presently preferred, it being understood, however, that the invention is not intended to be limited to the details shown because various modifications and structural changes may be made therein without departing from the spirit of the invention and within the scope and range of equivalents of the claims. The use of the same reference numerals or symbols in different drawings indicates similar or identical items.

DESCRIPTION OF REFERENCE NUMERALS OF MAIN PARTS OF THE DRAWINGS

| | |
|---|---|
| S100: dryer operating method | |
| S110: heating step | |
| S120: pressure reduction step | |
| S130: drying step | |
| S140: cooling step | |
| 10: user interface | 20: body |
| 100: tumbler | 800: reservoir |
| 200: fan | 810: discharge valve |
| 300: heat exchanger | 820: discharge line |
| 301: first inlet | 830: regeneration line |
| 302: first outlet | 840: control valve |
| 310: first header | FL: flow line |
| 320: second header | 850: circulation line |
| 330: first tube | 860: non-circulation line |
| 340: second tube | 861: extraction line |
| 350: return band | 862: entrance of extraction line |
| 400: compressor | 863: first pipe |
| 500: heating device | 864: second pipe |
| 600: accommodation part | 865: header |
| 601: second inlet | 866: branch line |
| 602: second outlet | 900: controller |
| 710: gas-liquid separator | 1000: heater controller |
| 720: steam trap | HS: humidity sensor |
| 730: decompression device | LP: infrared lamp |
| 740: bypass line | |
| 750: bypass valve | |

BEST MODE FOR CARRY OUT THE INVENTION

Hereinafter, exemplary embodiments of the present disclosure will be described in detail with reference to the accompanying drawings. In the following description of the present disclosure, a detailed description of known functions and configurations incorporated herein will be omitted to make the gist of the present disclosure clear.

Figure 1:
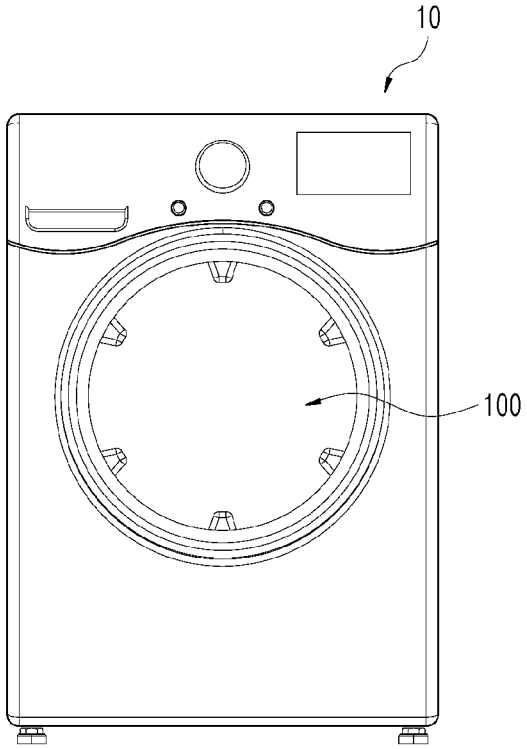
FIG. 1 is a view showing the external appearance of a dryer according to an embodiment of the present disclosure.

FIG. 1 is a view showing the external appearance of a dryer according to an embodiment. The dryer according to the embodiment may be used, for example, to dry laundry that has not been dried after completion of washing. Of course, the dryer may also be used to dry wet clothes, regardless of whether washing is performed.

An object to be dried may be received in a tumbler 100 provided in the dryer. Referring to FIG. 1, the tumbler 100 may be formed, for example, in a cylindrical shape, and may be provided so as to rotate as needed.

The dryer may be provided with a user interface 10. The user interface 10 may be electrically connected to a controller 900 to be described later, and a user may control the operation of the dryer using the user interface 10.

For example, the user interface 10 may be provided with a display, a capacitive touch button, a physical button, a dial, a speaker through which the dryer utters a voice, a microphone through which the user inputs a voice command, and the like.

Therefore, the user may obtain information necessary for operation from the dryer in the form of text, a voice, or the like. In addition, the user may input a voice command, or may manually manipulate the button, the dial, or the like in order to operate the dryer.

The dryer may further include a transceiver, which is connected to the controller 900, and the controller 900 may communicate with a server, a terminal of the user, and other external devices through the transceiver.

The transceiver may include at least one of a mobile communication module or a wireless Internet module. In addition, the transceiver may further include a short-range communication module.

The mobile communication module transmits and receives wireless signals to and from at least one of a base station, an external terminal, or a server via a mobile communication network established according to technical standards or communication schemes for mobile communication (for example, global system for mobile communication (GSM), code division multi access (CDMA), code division multi access 2000 (CDMA2000), enhanced voice-data optimized or enhanced voice-data only (EV-DO), wideband CDMA (WCDMA), high speed downlink packet access (HSDPA), high speed uplink packet access (HSUPA), long term evolution (LTE), long term evolution-advanced (LTE-A), $5^{th}$ generation (5G) mobile communication, and the like).

The wireless Internet module refers to a module for wireless Internet access. The wireless Internet module may be provided in the dryer. The wireless internet module is configured to transmit and receive wireless signals via a communication network using wireless Internet technology.

The dryer may transmit and receive data to and from a server and various terminals capable of performing communication via a 5G network. In particular, the dryer may perform data communication with the server and the terminals using at least one service among enhanced mobile broadband (eMBB), ultra-reliable and low latency communications (URLLC), and massive machine-type communications (mMTC) via a 5G network.

Enhanced mobile broadband (eMBB) is a mobile broadband service, and multimedia content, wireless data access, etc. are provided over eMBB. Further, improved mobile services, such as hotspots and broadband coverage for receiving mobile traffic, the amount of which is tremendously increasing, may be provided over eMBB. Through hotspots, high-volume traffic may be received in an area in which user mobility is low and user density is high. Through broadband coverage, a wide-range and stable wireless environment and user mobility may be ensured.

An ultra-reliable and low latency communications (URLLC) service defines much more stringent requirements than existing LTE in terms of reliability in data transmission/reception and transmission delay, and 5G services for automation of production processes at industrial sites, telemedicine, telesurgery, transportation, safety, etc. are representative examples thereof.

A massive machine-type communications (mMTC) service is a service that is not sensitive to transmission delay and is required for transmission of a relatively small amount of data. Terminals present in a much larger number than general mobile phones, such as sensors, may be connected to a wireless access network by mMTC at the same time. In this case, the communication module of the terminal needs to be inexpensive, and there is a need for improved power efficiency and power-saving technology enabling operation for years without replacement or recharging of a battery.

The dryer of the embodiment may employ a thermodynamic cycle in order to apply heat to the object to be dried received in the tumbler 100.

A working fluid used to implement the thermodynamic cycle of the dryer may be a mixture of air and gaseous water, i.e. steam. In this case, the ratio of air to steam in the working fluid may change while the working fluid circulates through the respective components of the dryer. Further, liquid water may temporarily account for part of the working fluid.

Figure 2:
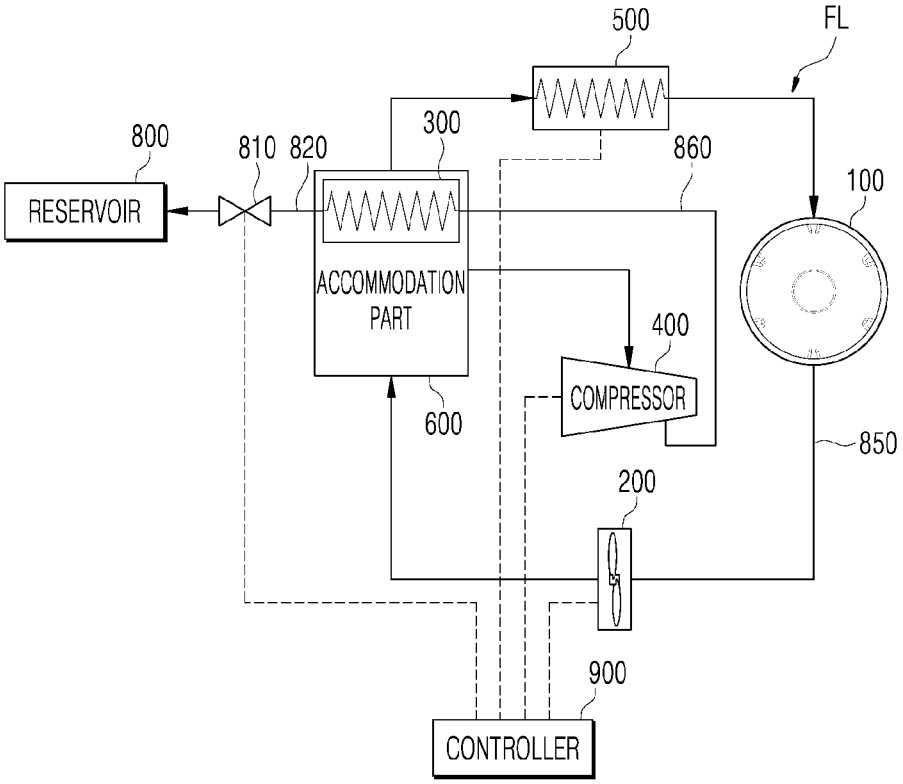
FIG. 2 is a diagram showing the structure of a dryer according to an embodiment of the present disclosure.

FIG. 2 is a diagram showing the structure of a dryer according to an embodiment.

The dryer may be provided with a flow line FL through which the working fluid flows. The flow line FL may interconnect respective components of the dryer, which will be described below. The flow line FL may be configured as, for example, a pipe, a hose, a duct, or a combination thereof.

In the dryer having the structures shown in FIG. 2 and the drawings below, the flow line FL of the working fluid may include a circulation line 850, a non-circulation line 860, a discharge line 820, or a regeneration line 830.

The circulation line 850 is a line interconnecting a heating device 500, a tumbler 100, a fan 200, and a heat exchanger 300, and the working fluid may circulate along the circulation line 850. The fan 200 may blow the working fluid so that the working fluid flows along the circulation line 850.

The non-circulation line 860 may branch from the circulation line 850 upstream of the heat exchanger 300 so as to be connected to a compressor 400, and may be connected to the compressor 400 and the heat exchanger 300. The working fluid flowing through the non-circulation line 860 may be introduced into and compressed by the compressor 400, and may then pass through the heat exchanger 300.

A portion of the working fluid in the circulation line 850 may be introduced into the non-circulation line 860, which branches from the circulation line 850. The working fluid introduced into the non-circulation line 860 may be compressed by the compressor 400, and thus may be heated to a high temperature.

The discharge line 820 may be connected to the exit of the heat exchanger 300, and a discharge valve 810 may be disposed in the discharge line 820. In addition, the discharge line 820 may be connected to a reservoir 800. The working fluid discharged from the heat exchanger 300 may be introduced into the reservoir 800, or may be discharged outside through the discharge line 820.

The heated working fluid discharged from the compressor 400 in the non-circulation line 860 may be introduced into the heat exchanger 300, may exchange heat with the working fluid in the circulation line 850, which has a relatively low temperature, and may be discharged from the heat exchanger 300.

Figure 5:
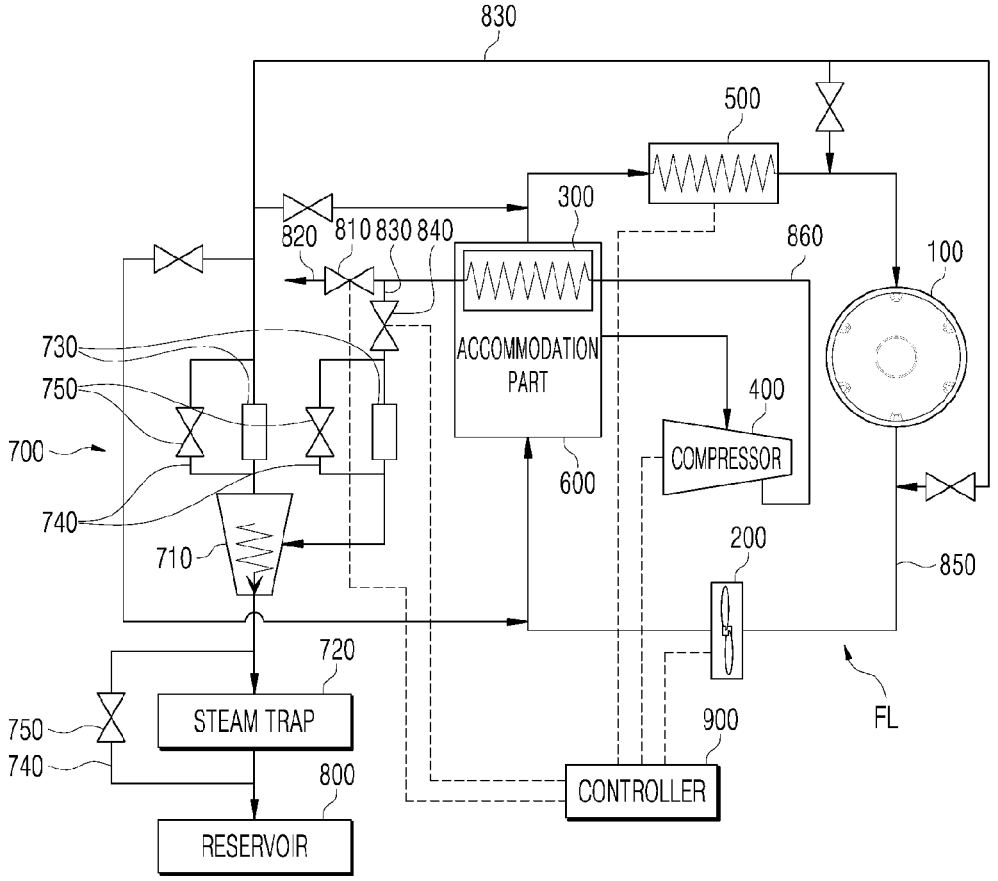
FIG. 5 is a diagram showing the structure of a dryer according to still another embodiment of the present disclosure.

The regeneration line 830 is a flow line FL of the working fluid that interconnects the exit of the heat exchanger 300 and the circulation line 850. As shown in FIG. 5, in one embodiment, a gas-liquid separator 710, a decompression device 730, and a steam trap 720 may be disposed in the regeneration line 830.

As described above, the working fluid in the circulation line 850 is heated by the heat exchanger 300, and is introduced into the tumbler 100 to heat the object to be dried accommodated in the tumbler 100, thereby drying the object to be dried.

After operation of the dryer commences, it is necessary to quickly heat the object to be dried in the initial stage of a drying operation in order to quickly and efficiently perform the drying operation. When the compressor 400 operates, the working fluid in the non-circulation line may be heated, and may exchange heat with the working fluid in the circulation line in the heat exchanger 300 to heat the working fluid in the circulation line.

According to the embodiment, the working fluid in the circulation line may be further heated using the heating device 500 in order to more rapidly heat the object to be dried to thus more quickly evaporate the water contained in the object to be dried.

This initial heating serves to heat the working fluid in the circulation line 850. In order to implement initial heating, the heating device 500 may be provided in the circulation line 850 connected to the entrance of the tumbler 100.

During initial heating, the object to be dried in the tumbler 100 is continuously heated, and accordingly, the water contained in the object to be dried continues to evaporate, so the working fluid in the circulation line 850 and the working fluid in the non-circulation line 860 contain a sufficient amount of steam. Thereby, heat exchange may be smoothly performed in the heat exchanger 300, and at this time initial heating may be terminated.

In one embodiment, the time period required for initial heating may be set in consideration of the specifications of the dryer, and initial heating may be terminated when the set time period elapses.

In another embodiment, the humidity of the working fluid may be measured using a humidity sensor, which is disposed at an appropriate position among the circulation line 850 of the working fluid, the non-circulation line 860 of the working fluid, and the respective components, and initial heating may be terminated when the humidity reaches a predetermined range.

The heating device 500 may heat the working fluid flowing through the circulation line 850. The heated working fluid may flow into the tumbler 100, and the object to be dried in the tumbler 100 may be heated by the working fluid. Accordingly, the water contained in the object to be dried may be evaporated and vaporized.

In the case in which only the heating device 500 is used for initial heating, initial heating may be stopped, for example, when water evaporates from the object to be dried, and thus steam is present at a predetermined proportion or greater in the circulation line 850. In this case, the proportion of steam is the ratio of steam to air in the working fluid.

The heating device 500, which is used for initial heating, may be configured as, for example, an electric heater. When the heating device 500 is used excessively during initial heating, a large amount of power is consumed, leading to deterioration in the efficiency of the dryer.

Therefore, according to the embodiment, in order to reduce power consumption by the heating device 500, which is configured as an electric heater, during initial heating, initial heating by the heating device 500 may be minimized.

Initial heating by the heating device 500 may be terminated, and the pressure in the tumbler 100 may be lowered using the compressor 400 so that evaporation of water actively occurs in the tumbler 100, whereby steam may be present at a predetermined proportion or greater in the circulation line 850.

That is, according to the embodiment, since initial heating using the heating device 500 and reduction of the pressure in the tumbler 100 using the compressor 400 are performed together, the proportion of steam in the circulation line 850 may reach or exceed a predetermined value.

Accordingly, according to the embodiment, since power consumption by the heating device 500 is reduced by greatly reducing initial heating using the heating device 500 and steam required for operation of the dryer is obtained using the compressor 400, the efficiency of the dryer may be improved.

Generation of steam in the circulation line 850 using the heating device and the compressor 400 will be described later in detail with reference to FIG. 3. Hereinafter, the structure and function of the dryer according to the embodiment will be described in detail with reference to FIG. 2.

Referring to FIG. 2, the dryer according to the embodiment may include a heating device 500, a tumbler 100, a fan 200, a heat exchanger 300, and a compressor 400.

The tumbler 100 may be connected to the exit of the heating device 500. The structure and function of the tumbler 100 are as described above.

The heating device 500 may be disposed between the tumbler 100 and the heat exchanger 300 in the circulation line 850. The heating device 500 may be configured as, for example, an electric heater.

As described above, the heating device 500 may be used, for example, for initial heating of the working fluid flowing through the circulation line 850. Operation of the heating device 500 may be stopped when initial heating is completed. In addition, even after initial heating is completed, the heating device 500 may be operated again at any time in order to heat the working fluid in the circulation line 850.

The fan 200 may be disposed so as to be connected to the exit of the tumbler 100. The fan 200 and the tumbler 100 may be connected to each other via the circulation line 850 of the working fluid. The fan 200 may blow the working fluid introduced from the tumbler 100 so that the working fluid circulates through the circulation line 850.

The heat exchanger 300 may be disposed in the flow line FL of the working fluid that is connected to the exit of the fan 200. That is, the heat exchanger 300 may be disposed in the circulation line 850 of the working fluid that interconnects the fan 200 and the tumbler 100.

In addition, the heat exchanger 300 may be configured such that the non-circulation line 860 of the working fluid, which is connected to the exit of the compressor 400, passes therethrough.

Due to this structure, the working fluid in the circulation line 850, which has a relatively low temperature, and the working fluid in the non-circulation line 860, which is compressed by the compressor 400 and thus has a relatively high temperature, may exchange heat therebetween in the heat exchanger 300.

Meanwhile, during initial heating, the working fluid in the non-circulation line 860 may be further heated, whereby heat exchange may occur more actively in the heat exchanger 300.

The working fluid in the circulation line 850, which is heated through the heat exchanger 300, may flow back into the tumbler 100, and may heat and dry the object to be dried in the tumbler 100.

The dryer according to the embodiment may further include an accommodation part 600, in which the heat exchanger 300 is accommodated and through which the working fluid flows. For example, the accommodation part 600 may be configured as a duct, and may constitute part of the circulation line 850.

The accommodation part 600 may be designed to have a large cross-sectional area in order to increase the contact area between the working fluid in the circulation line 850 and the surface of the heat exchanger 300, thereby increasing the efficiency of heat exchange between the working fluid in the circulation line 850 and the working fluid in the non-circulation line 860.

However, it is appropriate to set the cross-sectional area of the accommodation part 600 in consideration of the overall size of the dryer, the size of the space occupied by the accommodation part 600, and the size of the heat exchanger 300.

As shown in FIG. 2, the accommodation part 600 may be connected to the flow line FL connected to the exit of the fan 200, to the flow line FL connected to the entrance of the heating device 500, and to the flow line FL connected to the entrance of the compressor 400.

That is, the accommodation part 600 may be connected both to the circulation line 850 and to the non-circulation line 860 of the working fluid. The heat exchanger 300 may be configured as, for example, an open type, in which the working fluid in the circulation line 850 and the working fluid in the non-circulation line 860 mix with each other, or a closed type, in which the two working fluids flow separately from each other. The heat exchanger 300 according to the embodiment may be configured as, for example, a closed type.

When the closed-type heat exchanger 300 is used, the non-circulation line 860 of the working fluid may be directly connected to the heat exchanger 300 disposed in the accommodation part 600, and the working fluid in the non-circulation line 860 may be separated from the working fluid in the circulation line 850 inside the accommodation part 600, rather than being mixed therewith.

The compressor 400 may be connected at the entrance thereof to the flow line FL connected to the exit of the fan 200, and may be connected at the exit thereof to the entrance of the heat exchanger 300.

The compressor 400 may be connected to the non-circulation line 860 of the working fluid, and a portion of the working fluid flowing through the circulation line 850 may be introduced into the compressor 400. The working fluid introduced into the non-circulation line 860 may be compressed by the compressor 400 to a high temperature, and may then be introduced into the heat exchanger 300.

The compressor 400 may be configured as any of various types, such as, for example, a reciprocating type, a rotary type, a screw type, a scroll type, a centrifugal type, and an axial type. It is appropriate to select the type of compressor 400 in consideration of the size and the specific characteristics thereof.

The dryer according to the embodiment may further include a reservoir 800 and a controller 900.

The reservoir 800 may be connected to the discharge line 820 or the regeneration line 830. For example, the reservoir 800 may be connected to the exit of the discharge valve 810 disposed in the discharge line 820 or to the exit of the steam trap 720, and may store water discharged from the discharge line 820.

While the working fluid passes through the heat exchanger 300, the gas-liquid separator 710, or the steam trap 720 before entering the reservoir 800, at least a portion of the steam contained in the working fluid may be condensed, so liquid water, i.e. condensed water, may be generated. Thus, the reservoir 800 may store the condensed water introduced thereinto.

The controller 900 may be electrically connected to the heating device 500, the fan 200, the compressor 400, the discharge valve 810, and a control valve 840. In addition, the controller 900 may be electrically connected to other components of the dryer that need to be electrically controlled.

The controller 900 may control the respective components of the dryer, and thus may control the overall operation of the dryer according to the embodiment. For example, the controller 900 may apply power to the heating device 500, may control the operation of the fan 200, may control the operation of the compressor 400, or may control opening and closing of the discharge valve 810 or the control valve 840.

As described above, the controller 900 may be connected to the user interface 10 and the transceiver to receive a user's command, to transmit a necessary notification to the user, or to communicate with an external device such as a server.

The dryer may further include a discharge valve 810, which is connected to the exit of the heat exchanger 300. The discharge valve 810 may be electrically connected to the controller 900, and the controller 900 may control opening and closing of the discharge valve 810.

For example, the controller 900 may open the discharge valve 810 in order to reduce the pressure in the tumbler 100, and may close the discharge valve 810 in order to dry the object to be dried received in the tumbler 100.

When the discharge valve 810 is opened in the state in which the compressor 400 operates, a portion of the working fluid in the circulation line 850 may be discharged to the non-circulation line 860, and thus the pressure in the tumbler 100, which is disposed in the circulation line 850, may be reduced.

As described above, the dryer may include the discharge line 820. The discharge line 820 may be connected to the exit of the heat exchanger 300, and the discharge valve 810 may be disposed in the discharge line 820. One end of the discharge line 820 may be connected to the heat exchanger 300, and the other end of the discharge line 820 may be connected to the reservoir 800.

The working fluid discharged from the heat exchanger 300 may be introduced into the reservoir 800 through the discharge line 820.

Figure 3:
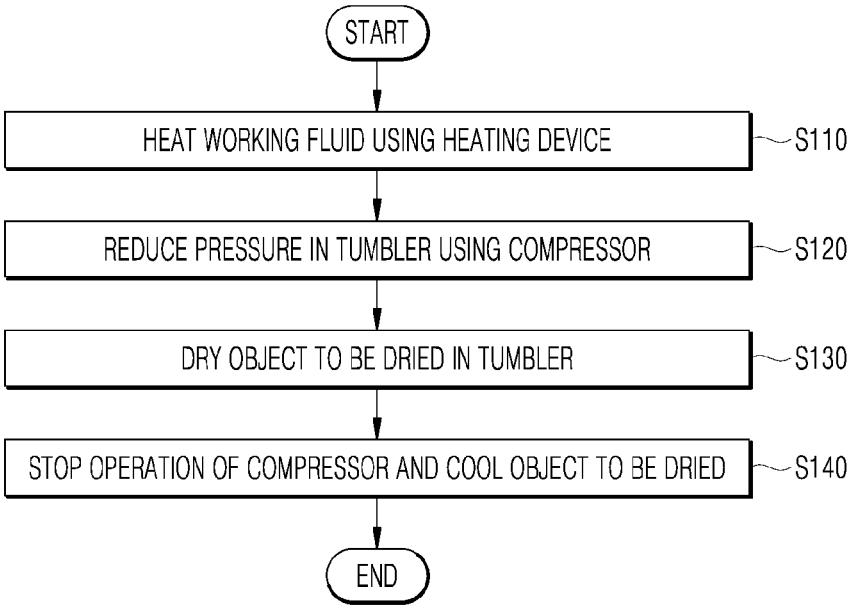
FIG. 3 is a flowchart showing a dryer operating method according to an embodiment of the present disclosure.

FIG. 3 is a flowchart showing a dryer operating method S100 according to an embodiment. As described above, the controller 900 may control the operation of the dryer.

The controller 900 may operate the heating device 500 to heat the working fluid (S110). In step S110, the discharge valve 810 is closed, the compressor 400 does not operate, and the heating device 500 and the fan 200 operate. Accordingly, the working fluid in the circulation line 850 may not flow into the compressor 400, and may be heated while continuously circulating through the circulation line 850.

When the circulation line 850 is appropriately heated, the controller 900 may stop the operation of the heating device 500. The operation of the heating device 500 may be stopped, for example, when a set time period elapses, or when the temperature or the humidity at a specific point along the circulation line 850, for example, in the tumbler 100, becomes a predetermined value or greater.

A temperature sensor and a humidity sensor may be provided at appropriate positions among the respective lines and the respective components of the dryer in order to measure temperature and humidity. The controller 900 may receive measurement values from the temperature sensor and the humidity sensor, and may determine whether to stop the operation of the heating device 500 based thereon.

Of course, when the operation of the heating device 500 is stopped, the proportion of steam in each of the circulation line 850 and the tumbler 100 does not reach a predetermined value.

The controller 900 may operate the compressor 400 to discharge a portion of the working fluid in the circulation line 850 to the outside, thereby reducing the pressure in the tumbler 100 (S120).

In step S120, the controller 900 may stop the operation of the heating device 500, may operate the fan 200, may operate the compressor 400, and may open the discharge valve 810.

Accordingly, a portion of the working fluid in the circulation line 850 may be discharged to the non-circulation line 860, and thus the pressure in the circulation line 850 and the pressure in the tumbler 100 may be reduced.

As the pressure in the tumbler 100 is reduced, the evaporation temperature of the water contained in the object to be dried received in the tumbler 100 may be lowered, and accordingly, evaporation of water may occur actively in the tumbler 100. As a result, the proportion of steam in each of the circulation line 850 and the tumbler 100 may increase.

However, in step S120, since a portion of the steam in the circulation line 850 is discharged to the reservoir 800, the proportion of steam in the circulation line 850 may decrease. Therefore, in order to maintain the proportion of steam in the circulation line 850 at a predetermined value or greater, it is necessary to maintain appropriate pressure in the tumbler 100.

The lower the pressure in the tumbler 100, the lower the vaporization temperature of the water. Therefore, it may be preferable to minimize the pressure in the tumbler 100 in order to increase the proportion of steam in the circulation line 850.

However, if the pressure in the tumbler 100 is excessively reduced, the amount of power consumed by the compressor 400 may increase. Therefore, based thereon, it is appropriate to control the operation of the compressor 400 so that the pressure in the tumbler 100 has an appropriate value.

When the proportion of steam in each of the circulation line 850 and the tumbler 100 becomes a predetermined value or greater, the dryer may perform a drying step. A determination as to whether the proportion of steam is equal to or greater than the predetermined value may be made using the humidity sensors disposed in the circulation line 850 and the tumbler 100.

In the drying step, the dryer may dry the object to be dried received in the tumbler 100 under the control of the controller 900 (S130). In step S130, the fan 200 and the compressor 400 may operate, the discharge valve 810 may be in an open state, and the heat exchanger 300 may operate due to the operation of the compressor 400.

Accordingly, the working fluid in the circulation line 850 may be heated by the heat exchanger 300, and may flow into the tumbler 100 to heat the object to be dried received in the tumbler 100, thereby drying the object to be dried.

In the step of drying the object to be dried received in the tumbler 100, at least a portion of the working fluid discharged from the heat exchanger 300 may be introduced into the circulation line 850.

That is, unlike step S120, in step S130, it is not necessary to reduce the pressure in the circulation line 850. In addition, the working fluid discharged from the heat exchanger 300 contains a large amount of heat, and this heat is input to the circulation line 850. Accordingly, the efficiency of the dryer may be improved.

To this end, the dryer according to the embodiment may include a regeneration line 830 for introducing the working fluid discharged from the heat exchanger 300 into the circulation line 850 in step S130. The regeneration line 830 will be described later in detail with reference to FIGS. 4 and 5.

While the drying step S130 is performed, condensed water may flow into the reservoir 800, and the overall humidity in the circulation line 850 and the amount of water contained in the object to be dried may gradually decrease, whereby the object to be dried may be dried.

When the drying step S130 is performed and thus the object to be dried is completely dried, a cooling step S140 may be performed. For example, when a set time period elapses, or when the humidity of the object to be dried is equal to or less than a predetermined value, it may be determined that the object to be dried has been completely dried.

In the cooling step, the controller 900 may stop the operation of the compressor 400, and may cool the object to be dried (S140). When the water contained in the object to be dried is sufficiently evaporated and dried, the dryer may cool the high-temperature object to be dried.

In general, in order to cool the object to be dried, outside air at room temperature is introduced into the circulation line 850, and a cooling operation is performed using the same. In the case of cooling the object to be dried using outside air, a flow line FL for introducing outside air into the circulation line 850, a valve, a blower, and other devices are required.

However, such additional equipment or devices may make it difficult to design the dryer, and may increase the cost of manufacturing the dryer.

Meanwhile, if outside air at room temperature and the working fluid in the circulation line 850 come into contact with each other, the temperature of at least a portion of the high-temperature working fluid may drop to the dew point temperature or lower due to the temperature difference therebetween, and the steam contained in the working fluid may be condensed, and thus condensed water may be generated.

Condensed water may have an adverse effect on the object to be dried, for example, may permeate into the object to be dried and may humidify the same. Therefore, in order to prevent condensation of steam in the circulation line 850 in the cooling step, outside air is heated to an appropriate temperature, and is then introduced into the circulation line 850.

Heating of outside air may be performed using the heating device 500 or the heat exchanger 300. In order to operate the heat exchanger 300, it is necessary to operate the compressor 400 in the cooling step.

However, if the heating device 500 or the compressor 400 is operated in order to heat outside air in the cooling step, a large amount of power may be consumed, and thus the efficiency of the dryer may be deteriorated.

Therefore, there is a need for a method of cooling the object to be dried without introducing outside air into the circulation line 850 in the cooling step or operating the heating device 500 and the compressor 400. The embodiment proposes a method of cooling the object to be dried that is capable of meeting the above requirements.

In step S140, that is, in the step of cooling the object to be dried, the operation of the compressor 400 may be stopped, and the working fluid may be circulated through the circulation line 850 using the fan 200. Since the compressor 400 does not operate, heat exchange in the heat exchanger 300 may gradually decrease, and thus the working fluid in the circulation line 850 may be gradually cooled.

In addition, the cooled working fluid, which circulates through the circulation line 850, may be introduced into the tumbler 100, and may cool the high-temperature object to be dried received in the tumbler 100. When the object to be dried is sufficiently cooled, the controller 900 may stop the operation of the fan 200 to terminate the drying operation.

According to the embodiment, since only the fan 200 is operated to cool the object to be dried without introducing outside air into the circulation line 850 or operating the heating device 500 and the compressor 400, it is possible to effectively prevent condensation of steam in the circulation line 850 due to introduction of outside air in the cooling step.

In addition, since the structure of the dryer is simplified, it is possible to facilitate design of the dryer and to reduce the cost of manufacturing the dryer.

In addition, since the heating device 500 and the compressor 400 are not operated in the cooling step, power consumption may be reduced, and accordingly, the efficiency of the dryer may be improved.

Figure 4:
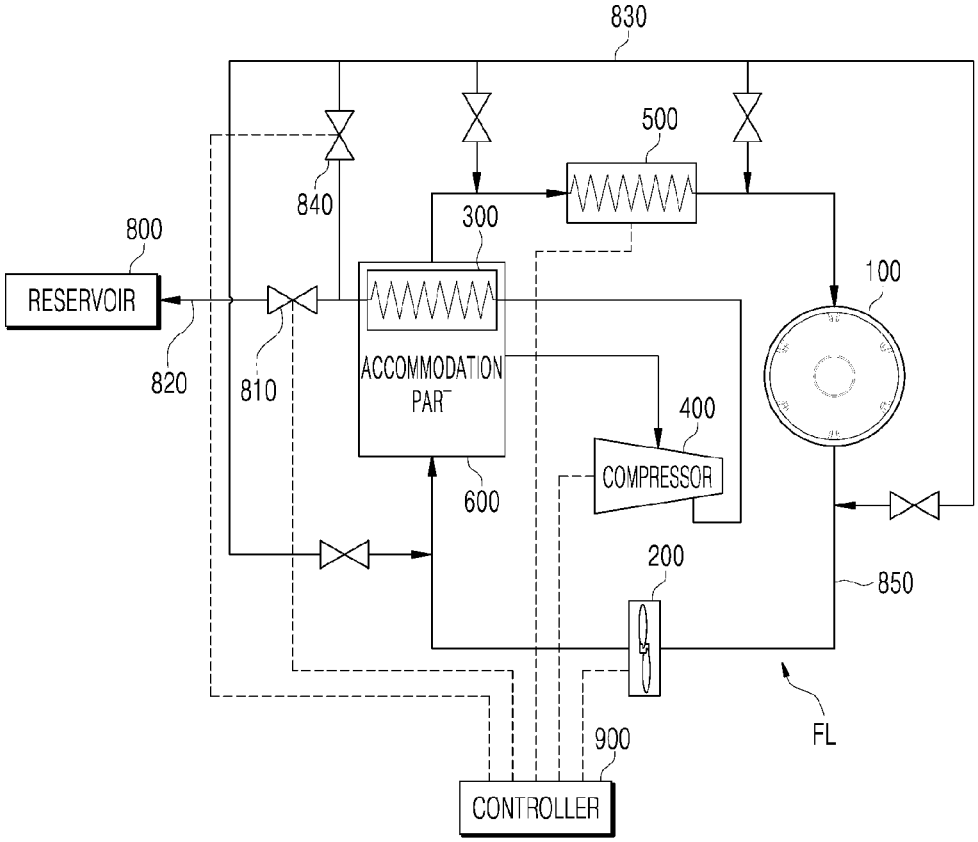
FIG. 4 is a diagram showing the structure of a dryer according to another embodiment of the present disclosure.

FIG. 4 is a diagram showing the structure of a dryer according to another embodiment.

As described above, the dryer may further include the regeneration line 830. The regeneration line 830 may branch at one end thereof from the discharge line 820, and may be connected at the other end thereof to the circulation line 850 of the working fluid.

The regeneration line 830 may be connected to at least one of the flow line FL of the working fluid interconnecting the heating device 500 and the tumbler 100, the flow line FL of the working fluid interconnecting the tumbler 100 and the fan 200, the flow line FL of the working fluid connected to the exit of the fan 200, or the flow line FL of the working fluid connected to the entrance of the heating device 500.

That is, as shown in FIG. 4, the circulation line 850 may be divided into four segment lines by the heating device 500, the tumbler 100, the fan 200, and the heat exchanger 300, and the regeneration line 830 may be connected to at least one of the four segment lines.

In one embodiment, as shown in FIG. 4, valves for controlling the flow of the working fluid may be mounted in respective regeneration lines, each of which is connected to a corresponding one of the four segment lines of the circulation line 850. The respective valves may be opened or closed so that the working fluid discharged from the heat exchanger 300 is introduced into all or some of the four segment lines of the circulation line 850.

In another embodiment, the regeneration line 830 may be connected to only some of the four segment lines of the circulation line 850.

Due to this structure, the working fluid discharged from the heat exchanger 300 may be introduced into all or some of the four segment lines of the circulation line 850. Since the working fluid introduced into the circulation line 850 from the heat exchanger 300 contains a relatively large amount of heat, the same may be used to heat the working fluid in the circulation line 850, and accordingly, the efficiency of the dryer may be improved.

In the pressure reduction step S120, it is appropriate to prevent the working fluid from being introduced into the circulation line 850 from the regeneration line 830 in order to realize pressure reduction, and in the drying step, it is appropriate to introduce the working fluid into the circulation line 850 from the regeneration line 830 in order to improve the efficiency of the dryer.

To this end, the dryer may further include a control valve 840, which is disposed in the regeneration line 830. The control valve 840 may be electrically connected to the controller 900, and opening and closing thereof may be controlled by the controller 900.

In the step S120 of reducing the pressure in the tumbler 100, the controller 900 may close the control valve 840, and in the step S130 of drying the object to be dried received in the tumbler 100, the controller 900 may open the control valve 840.

In order to effectively reduce the pressure in the circulation line 850 and in the tumbler 100 in step S120, the control valve 840 may be closed to prevent the working fluid from being introduced into the circulation line 850 from the regeneration line 830. If the working fluid is introduced into the circulation line 850 from the regeneration line 830, the introduced working fluid may increase the pressure in the circulation line 850 and in the tumbler 100.

In step S130, the control valve 840 may be opened so that the working fluid discharged from the heat exchanger 300 is introduced into the circulation line 850 and the same heats the working fluid in the circulation line 850. Accordingly, the efficiency of the heat exchanger 300 may be improved.

Meanwhile, the working fluid discharged from the heat exchanger 300 contains both condensed water and steam. It is appropriate to introduce steam, which contains a relatively large amount of heat, into the circulation line 850 through the regeneration line 830 and to discharge condensed water, which contains a relatively small amount of heat and thus contributes little to heating of the working fluid in the circulation line 850, to the reservoir 800.

Therefore, it is necessary for the regeneration line 830 to be provided with devices for separating condensed water and steam from each other to discharge the condensed water to the reservoir 800 and to introduce the steam into the circulation line 850. These devices may be, for example, a gas-liquid separator 710 and the steam trap 720, which will be described with reference to FIG. 5.

FIG. 5 is a diagram showing the structure of a dryer according to still another embodiment. Similar to the embodiment described above, in the embodiment shown in FIG. 5, in order to effectively reduce the pressure in the circulation line 850 and in the tumbler 100 in step S120, the control valve 840 may be closed to prevent the working fluid from being introduced into the circulation line 850 from the regeneration line 830. If the working fluid is introduced into the circulation line 850 from the regeneration line 830, the introduced working fluid may increase the pressure in the circulation line 850 and in the tumbler 100.

In step S130, the control valve 840 may be opened so that the working fluid discharged from the heat exchanger 300 is introduced into the circulation line 850 and the same heats the working fluid in the circulation line 850. Accordingly, the efficiency of the heat exchanger 300 may be improved.

Meanwhile, the discharge valve 810 according to the embodiment shown in FIG. 5 may be opened in step S120, and may be closed in step S130, thereby effectively discharging condensed water to the reservoir 800 and introducing steam into the circulation line 850.

Meanwhile, in the dryer shown in FIG. 5, the discharge line 820, which is connected to the exit of the discharge valve 810, may be connected to the reservoir 800.

As shown in FIG. 5, the dryer may include a gas-liquid separator 710, a steam trap 720, a decompression device 730, a bypass line 740, and a bypass valve 750.

The gas-liquid separator 710 may be connected at the entrance thereof to the exit of the heat exchanger 300. In addition, the gas exit of the gas-liquid separator 710 may be connected to the regeneration line 830. In addition, the condensate water exit of the gas-liquid separator 710 may be connected to the steam trap 720 and to the reservoir 800.

The working fluid introduced into the gas-liquid separator 710 may be separated into condensed water, which is liquid, and steam, which is gas. The condensed water separated in the gas-liquid separator 710 may be introduced into the reservoir 800, and the steam separated in the gas-liquid separator 710 may be introduced into the circulation line 850 through the regeneration line 830.

The working fluid introduced into the circulation line 850 from the gas-liquid separator 710 may circulate through the circulation line 850, and may be used to dry the object to be dried in the tumbler 100. Therefore, when the condensed water is introduced into the circulation line 850, it is required to input a large amount of heat, corresponding to the latent heat of evaporation, in order to evaporate the condensed water. This is disadvantageous compared to the case in which the regeneration line 830 is omitted.

Therefore, according to the embodiment, only steam, which does not require latent heat of evaporation, may be introduced into the circulation line 850 using the gas-liquid separator 710. Since only steam is introduced into the circulation line 850, it is not necessary to additionally apply heat corresponding to the latent heat of evaporation of the condensed water to the working fluid in the circulation line 850. Accordingly, the efficiency of the dryer may be improved.

As described above, the circulation line 850 may be divided into four segment lines by the heating device 500, the tumbler 100, the fan 200, and the heat exchanger 300, and the gas exit of the gas-liquid separator 710 may be connected to at least one of the four segment lines.

The steam trap 720 may be connected to the condensed water exit of the gas-liquid separator 710. The steam trap 720 may be disposed in the flow line FL interconnecting the condensed water exit of the gas-liquid separator 710 and the reservoir 800.

Steam and condensed water may not be completely separated from each other in the gas-liquid separator 710, and a portion of the condensed water discharged from the gas-liquid separator 710 may be vaporized due to a temporary pressure drop in the flow line FL, whereby additional steam may be generated.

For this reason, the working fluid discharged from the gas-liquid separator 710 may include steam as well as condensed water. Therefore, the steam trap 720 may be disposed in the flow line FL connected to the condensed water exit of the gas-liquid separator 710 in order to prevent steam from being discharged to the reservoir 800.

The condensed water contained in the working fluid introduced into the steam trap 720 passes through the steam trap 720 and is introduced into the reservoir 800, and the steam contained therein does not pass through the steam trap 720. The steam that does not pass through the steam trap 720 may be introduced into the circulation line 850 through the gas exit of the gas-liquid separator 710.

According to the embodiment, the steam trap 720, which is connected to the condensed water exit of the gas-liquid separator 710, is provided, whereby only condensed water is discharged from the gas-liquid separator 710 to the reservoir 800. Accordingly, the efficiency of the dryer may be improved.

The decompression device 730 may be provided in at least one of the flow line FL interconnecting the exit of the heat exchanger 300 and the entrance of the gas-liquid separator 710 or the flow line FL interconnecting the gas exit of the gas-liquid separator 710 and the discharge line 820.

Since the working fluid in the non-circulation line 860, which passes through the heat exchanger 300 and flows into the gas-liquid separator 710, is compressed by the compressor 400, the same is in a high-temperature and high-pressure state compared to the working fluid in the circulation line 850.

Therefore, the pressure and temperature need to be reduced so that the steam flowing into the circulation line 850 through the regeneration line 830 has pressure and temperature equal to or similar to those of the working fluid in the circulation line 850.

According to the embodiment, the decompression device 730 may be mounted in at least one of a segment regeneration line disposed upstream of the gas-liquid separator 710 or a segment regeneration line disposed downstream of the gas-liquid separator 710, whereby the temperature and pressure of the steam discharged from the gas exit of the gas-liquid separator 710 and introduced into the circulation line 850 may be lowered so as to be suitable for the circulation line 850.

The decompression device 730 may be configured as, for example, an expansion valve, a throttling device, a capillary device, or the like. However, the disclosure is not limited thereto, and the decompression device 730 may have any of various structures, so long as the same is capable of lowering the pressure and temperature of the working fluid.

The bypass line 740 may be provided in plural such that the two ends of one bypass line 740 are connected to respective ends of the decompression device 730 and the two ends of another bypass line 740 are connected to respective ends of the steam trap 720.

A bypass valve 750 may be disposed in each bypass line 740.

In an emergency state in which the decompression device 730 or the steam trap 720 malfunctions or operates abnormally, it is necessary to move the working fluid so as to bypass the same.

In such an emergency state, the bypass valve 750 may be opened so that the working fluid bypasses the decompression device 730 or the steam trap 720 through the bypass line 740.

Figure 6:
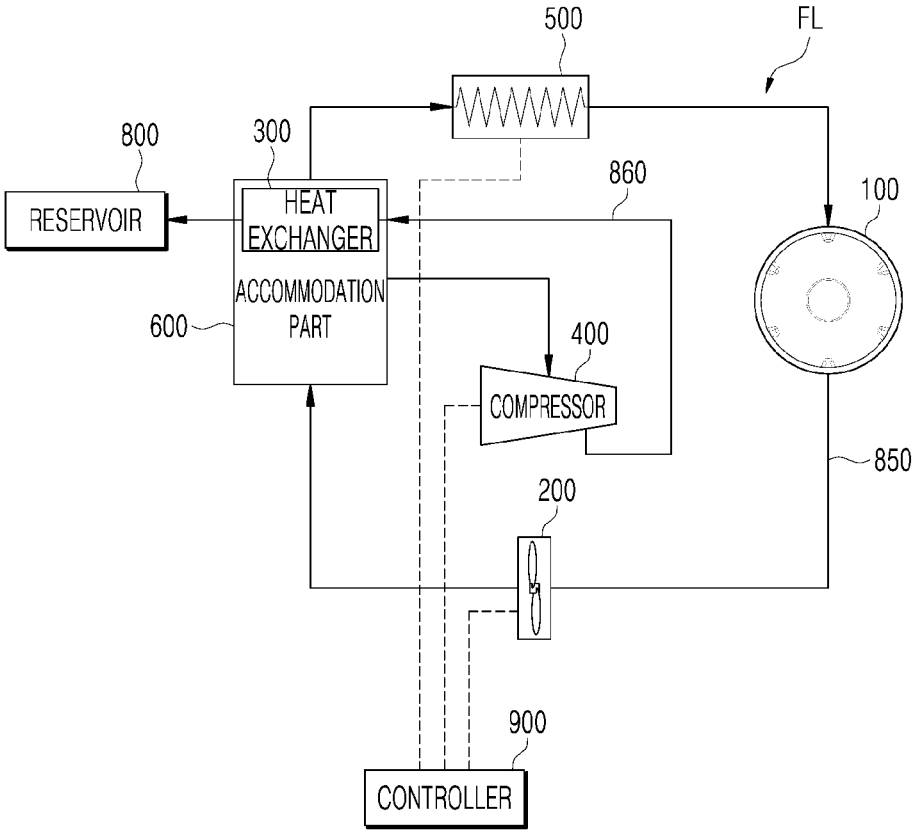
FIG. 6 is a diagram showing the structure of a dryer according to still another embodiment.

FIG. 6 is a diagram showing the structure of a dryer according to still another embodiment.

The heat exchanger 300 according to the embodiment may be configured such that the working fluid having a relatively high temperature introduced from the compressor 400 passes through a narrow closed pipe and such that the working fluid having a relatively low temperature introduced from the fan 200 and passing through the accommodation part 600 comes into contact with the outer surface of the pipe.

Due to this structure, heat may be transferred from the working fluid having a relatively high temperature, which passes through the pipe, to the working fluid having a relatively low temperature, which contacts the outer surface of the pipe and passes through the accommodation part 600.

During heat transfer, the working fluid passing through the pipe of the heat exchanger 300 may lose heat, and a portion thereof may be condensed to water. If condensed water collects in the pipe of the heat exchanger 300, the rate of flow of the working fluid in the pipe of the heat exchanger 300 may be deteriorated.

In severe cases, condensed water collecting in the pipe of the heat exchanger 300 may completely block the inside of the pipe, leading to a steam trap phenomenon in which steam is not capable of passing through the pipe, which is clogged with condensed water.

If condensed water collects in the pipe of the heat exchanger 300 or a steam trap phenomenon occurs therein, the heat exchange efficiency of the heat exchanger 300 may be greatly deteriorated, and foreign substances contained in the condensed water may collect in the pipe, thus greatly shortening the lifespan of the heat exchanger 300.

Therefore, in order to increase the heat exchange efficiency of the heat exchanger 300 and prolong the lifespan thereof, there is a need for a structure capable of preventing condensed water from collecting in the pipe of the heat exchanger 300. The dryer according to the embodiment proposes a heat exchanger 300 having a structure related thereto.

The heat exchanger 300 may include a first inlet 301, through which the working fluid is introduced thereinto from the compressor 400, and a first outlet 302, through which the working fluid is discharged from the heat exchanger 300. In this case, the height of the first inlet 301 may be set to be higher than the height of the first outlet 302.

The term "height" or "high" is used to indicate the positions of the first inlet 301 and the second inlet 601, which are measured in the direction in which gravity acts, i.e. the direction of gravity.

Due to this structure, the working fluid introduced into the first inlet 301 may be discharged to the first outlet 302, which is located at a lower position than the first inlet 301.

Therefore, the steam contained in the working fluid may be introduced into the pipe of the heat exchanger 300 through the first inlet 301, and may lose heat through heat exchange, whereby a portion thereof becomes condensed water. In this case, the condensed water may move to the first outlet 302, which is located at a lower position than the first inlet 301, due to gravity, may be discharged from the heat exchanger 300, and may be introduced into the reservoir 800.

In other words, since the first inlet 301 is located at a higher position than the first outlet 302, condensed water generated in the pipe of the heat exchanger 300 may be smoothly discharged outside the heat exchanger 300 through the first outlet 302 due to gravity. Accordingly, it is possible to effectively prevent condensed water from collecting in the heat exchanger 300.

Hereinafter, the structure of the heat exchanger 300 described above will be described in more detail with reference to the accompanying drawings.

Figure 7:
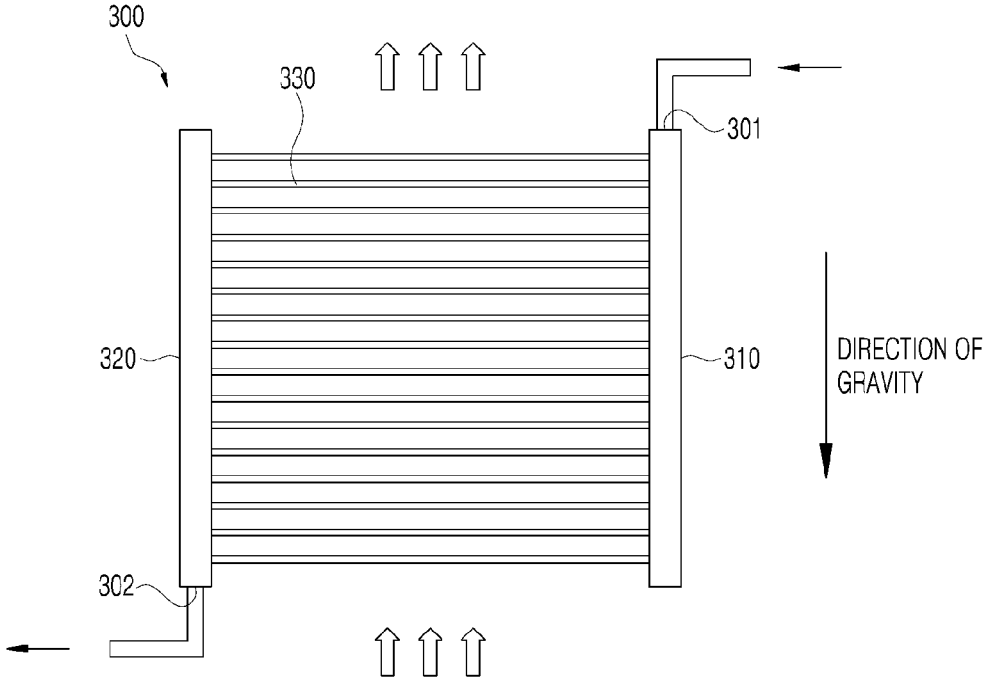
FIG. 7 is a diagram showing a heat exchanger according to still another embodiment.
Figure 8:
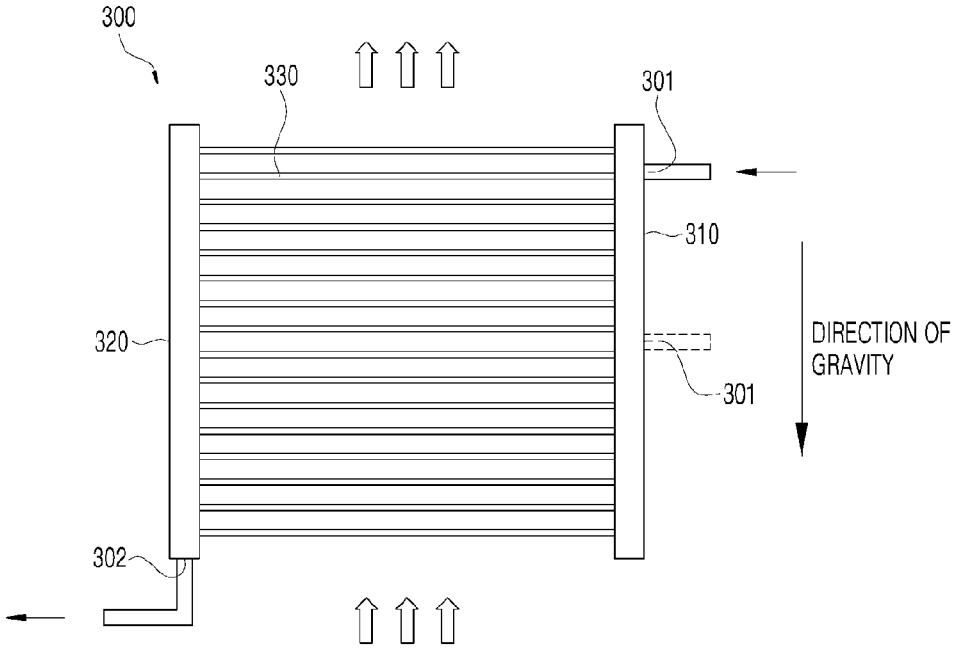
FIG. 8 is a diagram showing a heat exchanger according to still another embodiment.

FIG. 7 is a diagram showing a heat exchanger 300 according to still another embodiment. In FIGS. 7 and 8, the arrows pointing upwards in the drawing sheet indicate the direction in which the working fluid in the circulation line 850, which is introduced from the fan 200, flows inside the accommodation part 600.

In addition, the arrows pointing leftwards in the drawing sheet indicate the direction in which the working fluid in the non-circulation line 860, which is introduced from the compressor 400, flows through the heat exchanger 300. In this case, the pipe adjacent to the arrow shown on the left in the drawing sheet is a pipe interconnecting the heat exchanger 300 and the reservoir 800, and the pipe adjacent to the arrow shown on the right in the drawing sheet is a pipe interconnecting the heat exchanger 300 and the compressor 400.

In addition, the arrows pointing downwards in the drawing sheet indicate the direction in which gravity acts, i.e. the direction of gravity.

Referring to FIG. 7, the heat exchanger 300 may include a first header 310, a second header 320, and a first tube 330.

The first header 310 may be disposed such that the longitudinal direction thereof is parallel to the upward-downward direction, and the first inlet 301 may be formed in the first header 310. The second header 320 may be disposed such that the longitudinal direction thereof is parallel to the upward-downward direction, and the first outlet 302 may be formed in the second header 320.

The two ends of the first tube 330 may be respectively connected to the first header 310 and the second header 320. The first tube 330 may be provided in plural. The plurality of first tubes 330 may be disposed at predetermined intervals in the upward-downward direction.

The first tube 330 may be disposed such that the longitudinal direction thereof intersects the longitudinal direction of the first header 310 and the longitudinal direction of the second header 320. Since the longitudinal direction of the first header 310 and the longitudinal direction of the second header 320 are parallel to or approximately parallel to the direction in which the working fluid flows through the circulation line 850, the longitudinal direction of the first tube 330 intersects the flow line FL of the working fluid flowing through the circulation line 850. Therefore, in the accommodation part 600, the flow direction of the working fluid in the non-circulation line 860 and the flow direction of the working fluid in the circulation line 850 are perpendicular to or approximately perpendicular to each other. Accordingly, heat exchange may occur actively.

The working fluid discharged from the compressor 400 may be introduced into the first header 310, and heat exchange may primarily occur in the first tube 330 while the working fluid flows through the first tube 330. The working fluid discharged from the first tube 330 may collect in the second header 320, and may escape from the heat exchanger 300 through the outlet formed in the second header 320.

As shown in FIG. 7, the first inlet 301 is disposed at a higher position than the first outlet 302. Accordingly, the steam contained in the working fluid introduced into the first inlet 301 may be condensed in the first tube 330 by heat exchange, and the condensed water may smoothly move to the first outlet 302 due to gravity.

Due to this structure, it is possible to prevent condensed water from collecting in the first tube 330 and thus to prevent the occurrence of a steam trap phenomenon due to collection of condensed water in the first tube 330.

As shown in FIGS. 7 and 8, the first tube 330 may be disposed such that the longitudinal direction thereof is perpendicular to the direction of gravity. In another embodiment, in order to make condensed water smoothly move through the first tube 330 due to gravity, the first tube 330 may be disposed such that the longitudinal direction thereof is inclined with respect to the direction of gravity. Specifically, the end of the first tube 330 that is connected to the first header 310 may be located at a higher position than the end of the first tube 330 that is connected to the second header 320.

As shown in FIG. 7, the heat exchanger 300 may be formed such that the first inlet 301 is formed in the upper end of the first header 310 and the first outlet 302 is formed in the lower end of the second header 320, whereby the first inlet 301 may be located at a higher position than the first outlet 302.

Due to this structure, in the heat exchanger 300 in which the first header 310 and the second header 320 have the same length, the height difference between the first inlet 301 and the first outlet 302 may be maximized.

FIG. 8 is a diagram showing a heat exchanger 300 according to still another embodiment. In the heat exchanger 300, the first inlet 301 may be formed in the side surface of the first header 310, and the first outlet 302 may be formed in the lower end of the second header 320.

The heat exchanger 300 shown in FIG. 8 is different from the heat exchanger 300 shown in FIG. 7 in that the first inlet 301 is formed in the side surface of the first header 310.

In order to make condensed water smoothly escape from the heat exchanger 300 due to gravity, it is appropriate for the first outlet 302 to be formed in the lowermost portion of the heat exchanger 300, for example, the lower end of the second header 320. However, since gravity acts on the condensed water when the first inlet 301 is located at a higher position than the first outlet 302, the first inlet 301 may be formed in the side surface of the first header 310.

Therefore, as indicated by the real-line pipe in FIG. 8, the first inlet 301 may be formed in the upper portion of the side surface of the first header 310. In another embodiment, as indicated by the dotted-line pipe in FIG. 8, the first inlet 301 may be formed in the middle portion of the side surface of the first header 310.

In the above cases, it is also appropriate for the first inlet 301 to be formed at a higher position than the first outlet 302.

Figure 9:
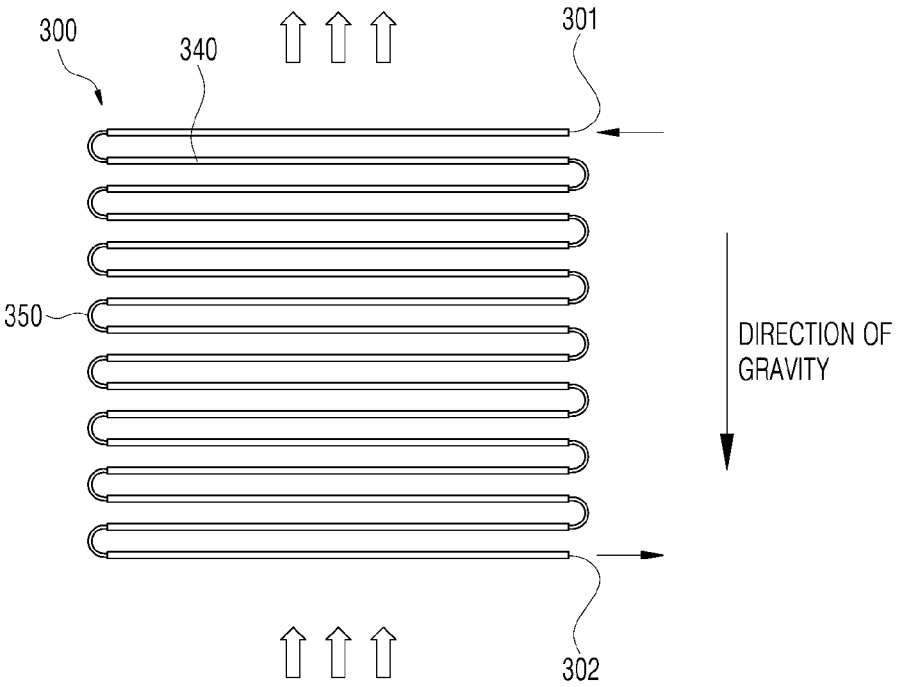
FIG. 9 is a diagram showing a heat exchanger according to still another embodiment.

FIG. 9 is a diagram showing a heat exchanger 300 according to still another embodiment. In FIG. 9, the arrows pointing upwards in the drawing sheet indicate the direction in which the working fluid in the circulation line 850, which is introduced from the fan 200, flows inside the accommodation part 600.

In addition, the arrow pointing leftwards in the drawing sheet indicates the flow direction of the working fluid that is introduced into the heat exchanger 300 from the compressor 400. In addition, the arrow pointing rightwards in the drawing sheet indicates the flow direction of the working fluid that is discharged from heat exchanger 300 to the reservoir 800.

In addition, the arrow pointing downwards in the drawing sheet indicates the direction in which gravity acts, i.e. the direction of gravity.

As shown in FIG. 9, the heat exchanger 300 may include a second tube 340 and a return band 350.

The second tube 340 may be provided in plural. The plurality of second tubes 340 may be disposed at predetermined intervals in the upward-downward direction. The return band 350 may interconnect the exit of one of the second tubes 340 and the entrance of an adjacent one of the second tubes 340.

The second tube 340 may be disposed such that the longitudinal direction thereof intersects the upward-downward direction, i.e. the direction of gravity. Since the direction in which the working fluid flows through the circulation line 850 is parallel to or approximately parallel to the direction of gravity, the longitudinal direction of the second tube 340 and the flow direction of the working fluid are perpendicular to or approximately perpendicular to each other. Accordingly, heat exchange may occur actively.

Since the return band 350 is connected to the ends of adjacent ones of the second tubes 340, the heat exchanger 300 may have a single flow path. In addition, the heat exchanger 300 may be formed in a zigzag shape in the upward-downward direction.

The second tubes 340 may be disposed such that the longitudinal direction thereof is perpendicular to the direction of gravity. In another embodiment, in order to make condensed water smoothly move through the second tubes 340 and the return band 350 due to gravity, the second tubes 340 may be disposed such that the longitudinal direction of one of the second tubes 340 is inclined in one direction with respect to the direction of gravity and such that the longitudinal direction of an adjacent one of the second tubes 340 is inclined in another direction with respect to the direction of gravity.

In this case, the first inlet 301 may be formed in an end of the second tube 340 that is disposed at the uppermost position among the plurality of second tubes 340, and the first outlet 302 may be formed in an end of the second tube 340 that is disposed at the lowermost position among the plurality of second tubes 340.

Due to this structure, the steam contained in the working fluid introduced into the first inlet 301 may lose heat while flowing through the plurality of second tubes 340 and the return band 350, and thus may be changed to condensed water. The condensed water may smoothly move to the first outlet 302, which is located at the lowermost portion of the heat exchanger 300, due to gravity.

Due to this structure, since the condensed water generated in the heat exchanger 300 smoothly moves to the first outlet 302 due to gravity, it is possible to prevent the condensed water from collecting in the second tubes 340 and the return band 350 and thus to prevent the occurrence of a steam trap phenomenon due to collection of the condensed water in the heat exchanger 300.

Meanwhile, the flow direction of at least a portion of the working fluid flowing outside the heat exchanger 300 and the flow direction of at least a portion of the working fluid flowing inside the heat exchanger 300 may be opposite each other.

For example, referring to FIGS. 7 to 9, the first inlet 301 may be disposed further backwards than the first outlet 302 based on the flow direction of the working fluid flowing outside the heat exchanger 300.

Due to this structure, the overall flow direction of the working fluid in the circulation line 850 and the overall flow direction of the working fluid in the non-circulation line 860 may be opposite each other in the accommodation part 600. That is, counter-flow heat exchange may occur in the heat exchanger 300.

According to the embodiment, the flow direction of the working fluid in the circulation line 850 and the flow direction of the working fluid in the non-circulation line 860 may be set so as to realize counter-flow heat exchange, in which the working fluids flowing in opposite directions exchange heat with each other. Accordingly, the heat exchange efficiency of the heat exchanger 300 may be improved compared to parallel-flow heat exchange, in which working fluids flowing in the same direction exchange heat with each other.

The counter-flow heat exchange exhibits higher heat exchange efficiency at all times than the parallel-flow heat exchange under the same conditions, such as at the same flow rate or at the same temperature.

Figure 10:
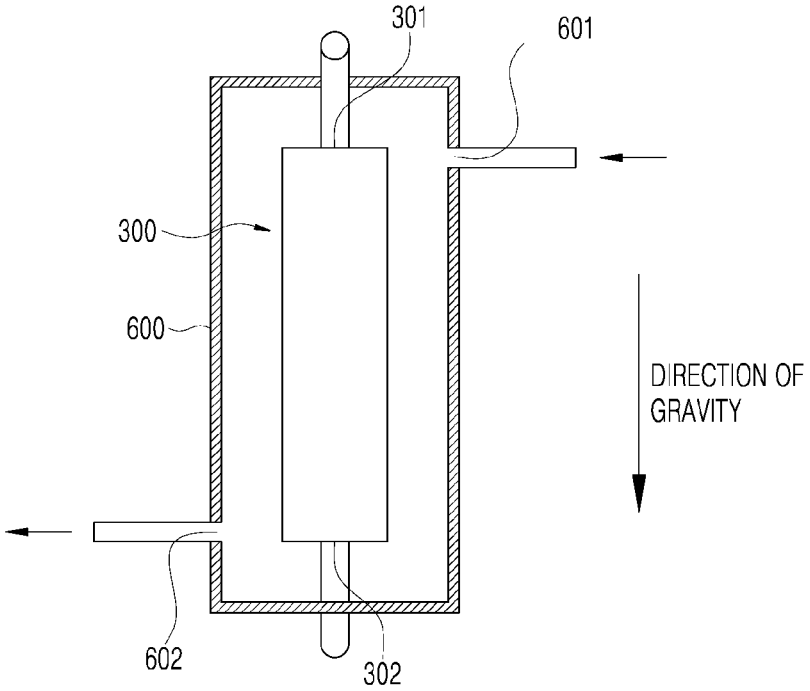
FIG. 10 is a diagram showing the structure of an accommodation part according to still another embodiment.

FIG. 10 is a diagram showing the structure of an accommodation part 600 according to still another embodiment. FIG. 10 schematically illustrates the side surface of the heat exchanger 300 shown in FIG. 7. The heat exchangers 300 of the embodiments shown in FIGS. 4 and 9 may also be illustrated similar to that shown in FIG. 10. Since it will be apparent to those skilled in the art that the heat exchangers 300 shown in FIGS. 8 and 9 are applicable to the configuration shown in FIG. 10, illustration thereof will be omitted.

The accommodation part 600 may include a second inlet 601 and a second outlet 602. The working fluid flowing outside the heat exchanger 300 may be introduced into and discharged from the accommodation part 600 through the second inlet 601 and the second outlet 602.

That is, the working fluid in the circulation line 850 may pass through the fan 200, and may then be introduced into the accommodation part 600 through the second inlet 601. Subsequently, the working fluid may escape from the accommodation part 600 through the second outlet 602, and may then circulate through the heating device 500, the tumbler 100, and the fan 200.

In this case, the second inlet 601 may be disposed adjacent to the first outlet 302, and the second outlet 602 may be disposed adjacent to the first inlet 301. Therefore, the second inlet 601 may be disposed at a higher position than the second outlet 602.

Due to this structure, the second inlet 601 may be disposed at a higher position than the second outlet 602 based on the direction of gravity. Therefore, the working fluid flowing through the circulation line 850 may flow in the downward direction, i.e. the direction of gravity, in the accommodation part 600, and the working fluid flowing through the non-circulation line 860 may flow in the upward direction, i.e. the direction opposite the direction of gravity, in the accommodation part 600 and the heat exchanger 300.

Therefore, according to the embodiment, since the working fluid in the circulation line 850 and the working fluid in the non-circulation line 860 flow in opposite directions in the accommodation part 600 and the heat exchanger 300, counter-flow heat exchange may occur.

Figure 11:
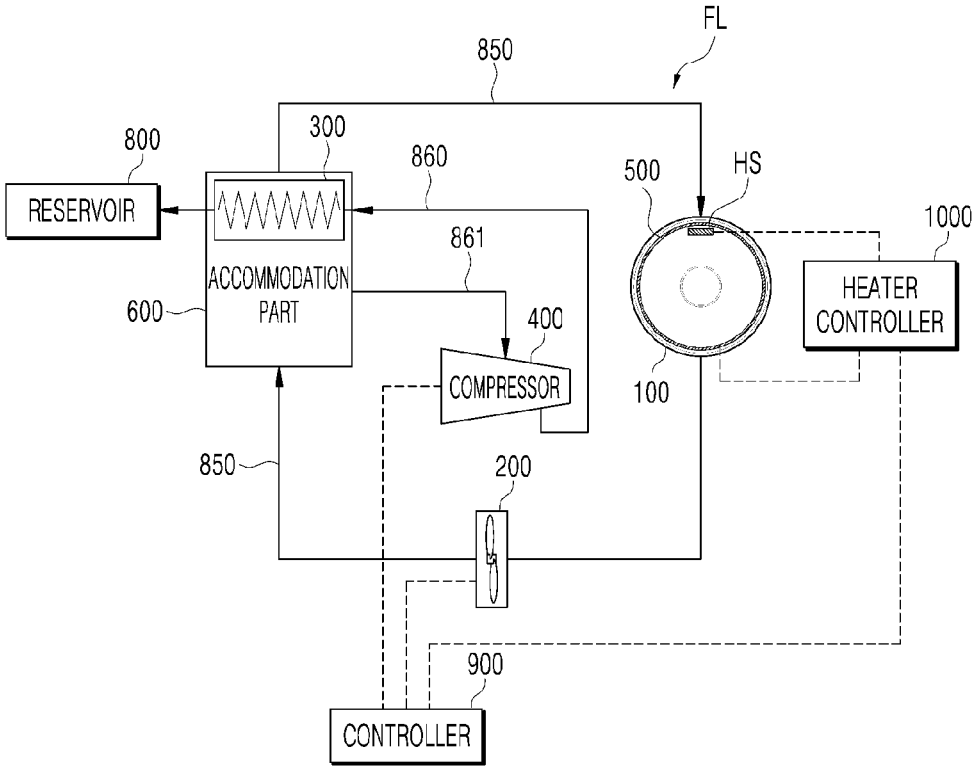
FIG. 11 is a diagram showing the structure of a dryer according to still another embodiment.

FIG. 11 is a diagram showing the structure of a dryer according to still another embodiment.

Hereinafter, the part of the non-circulation line 860 that interconnects the circulation line 850 and the compressor 400 will be referred to as an extraction line 861.

As shown in FIG. 11, the accommodation part 600 may be connected to the circulation line 850 connected to the exit of the fan 200, to the circulation line 850 connected to the entrance of the tumbler 100, and to the extraction line 861 connected to the entrance of the compressor 400.

In addition, the entrance of the compressor 400 may be connected to the circulation line 850 of the working fluid that is connected to the exit of the fan 200, and the exit of the compressor 400 may be connected to the entrance of the heat exchanger 300.

The extraction line 861 may interconnect the circulation line 850 and the entrance of the heat exchanger 300. The extraction line 861 may constitute part of the non-circulation line 860. The extraction line 861 will be described later in detail.

The reservoir 800 may be connected to the exit of the heat exchanger 300. While the working fluid discharged from the compressor 400 passes through the heat exchanger 300, at least a portion of the steam contained in the working fluid may be condensed, so liquid water, i.e. condensed water, may be generated. Thus, the reservoir 800 may store the condensed water introduced from the heat exchanger 300.

The controller 900 may be electrically connected to the fan 200, the compressor 400, and a heater controller 1000 to be described later. In addition, the controller 900 may be electrically connected to other components of the dryer that need to be electrically controlled.

The controller 900 may control the respective components of the dryer, and thus may control the overall operation of the dryer according to the embodiment. For example, the controller 900 may apply power to the heating device 500 through the heat controller 1000, or may control the operation of the fan 200, the compressor 400, and the heater controller 1000.

As described above, the controller 900 may be connected to the user interface 10 and the transceiver to receive a user's command, to transmit a necessary notification to the user, or to communicate with an external device such as a server.

Figure 12:
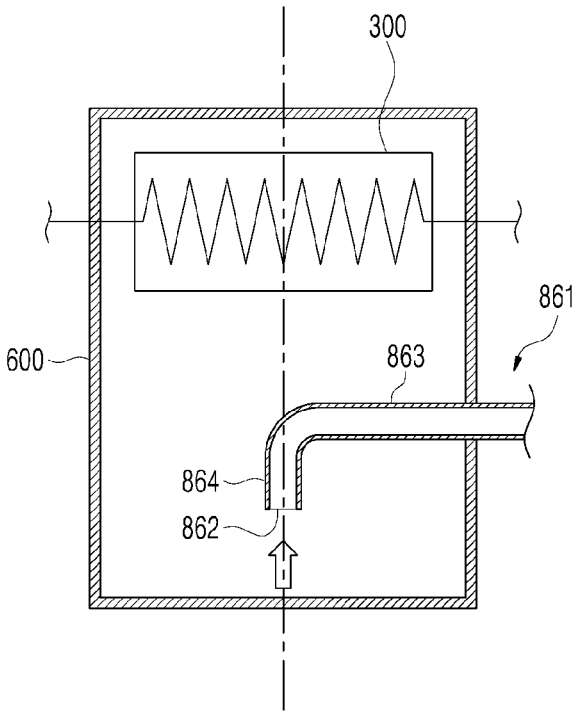
FIG. 12 is a diagram for explaining the internal structure of an accommodation part according to still another embodiment.

FIG. 12 is a diagram for explaining the internal structure of an accommodation part 600 according to still another embodiment. In FIG. 12, the arrow indicates the direction in which the working fluid flows in the accommodation part 600.

In order to increase the heat exchange efficiency of the heat exchanger 300, it is necessary to increase the amount of working fluid that is introduced into the compressor 400 through the extraction line 861.

In order to increase the amount of working fluid that is introduced into the compressor 400, a method of increasing the capacity of the compressor 400 may be proposed. In order to increase the capacity of the compressor 400, the volume of the compressor 400 needs to be increased. However, there is a limitation on the extent to which the size of the compressor 400 can be increased due to spatial limitations.

Therefore, it is necessary to improve the structure of the extraction line 861 in order to increase the amount of working fluid that is introduced into the compressor 400, independently of the size of the compressor 400.

According to the embodiment, as shown in FIG. 12, the entrance 862 of the extraction line may be disposed so as to face the working fluid flowing through the circulation line 850 in order to increase the amount of working fluid that is introduced into the compressor 400.

That is, the entrance 862 of the extraction line may be located inside the accommodation part 600, and may be disposed so as to face in the direction opposite the flow direction of the working fluid in the accommodation part 600.

Due to this structure, the amount of working fluid that is introduced into the entrance 862 of the extraction line may increase compared to the case in which the entrance 862 of the extraction line faces in the direction perpendicular to the flow direction of the working fluid or faces in the same direction as the flow direction of the working fluid.

The reason for this that, when the entrance 862 of the extraction line is disposed so as to face the working fluid flowing inside the accommodation part 600, the working fluid can be introduced into the entrance 862 of the extraction line without a change in the flow direction thereof.

For example, the extraction line 861 may include a first pipe 863 and a second pipe 864. The first pipe 863 and the second pipe 864 may be integrally formed with each other.

The first pipe 863 may be connected at one end thereof to the compressor 400, and may penetrate the wall of the accommodation part 600 such that the other end thereof is disposed inside the accommodation part 600.

The second pipe 864 may be bent and extend from the other end of the first pipe 863 such that the longitudinal direction of at least a portion thereof is parallel to the direction in which the working fluid flows inside the accommodation part 600.

The entrance 862 of the extraction line may be formed in the end of the second pipe 864. The entrance 862 of the extraction line may be disposed so as to face the working fluid flowing inside the accommodation part 600.

Due to this structure, the working fluid flowing inside the accommodation part 600 may be introduced into the extraction line 861 without a change in the flow direction thereof. Accordingly, the amount of working fluid that is introduced into the extraction line 861 may increase compared to the case in which the entrance 862 of the extraction line faces in the direction perpendicular to the flow direction of the working fluid or faces in the same direction as the flow direction of the working fluid.

According to the embodiment, since the entrance 862 of the extraction line is disposed so as to face the working fluid flowing through the circulation line 850, the amount of working fluid that is introduced into the compressor 400 may increase, and accordingly, the heat exchange efficiency of the heat exchanger 300 may increase.

In order to increase the heat exchange efficiency of the heat exchanger 300, the working fluid flowing into the compressor 400 needs to have a high heat content. The working fluid having a high heat content is a working fluid containing a large amount of heat.

In order to increase the heat content of the working fluid, it is necessary to increase the temperature of the working fluid.

In addition, in order to increase the heat content of the working fluid, it is necessary to increase the proportion of steam in the working fluid. The reason for this is that the working fluid is a mixture of air and steam, and steam can contain a larger amount of heat than air.

Therefore, in order to increase the heat exchange efficiency of the heat exchanger 300, it is necessary to maximize the temperature of the working fluid flowing into the compressor 400 and the proportion of steam therein. To this end, according to the embodiment, as shown in FIG. 12, the entrance 862 of the extraction line may be disposed at the center portion of the cross-section of the accommodation part 600.

In this case, the working fluid may flow inside the accommodation part 600 in the direction perpendicular to the cross-section of the accommodation part 600.

The temperature of the working fluid flowing along the cross-section of the accommodation part 600 may be the lowest at the portion adjacent to the edge of the accommodation part 600, i.e. the wall surface of the accommodation part 600, and may be the highest at the center portion of the accommodation part 600. The reason for this is that the working fluid may be cooled at the edge of the accommodation part 600 by outside air.

Similarly, the proportion of steam in the working fluid flowing along the cross-section of the accommodation part 600 may be the lowest at the portion adjacent to the edge of the accommodation part 600, i.e. the wall surface of the accommodation part 600, and may be the highest at the center portion of the accommodation part 600. The reason for this is that a portion of the steam contained in the working fluid may be cooled to the dew point temperature or lower at the edge of the accommodation part 600 by outside air and thus may be condensed.

According to the embodiment, since the entrance 862 of the extraction line is disposed at the center portion of the cross-section of the accommodation part 600, at which the temperature of the working fluid and the proportion of steam therein are the highest, the heat content of the working fluid flowing into the compressor 400 may increase compared to the case in which the entrance 862 of the extraction line is disposed at the edge of the cross-section of the accommodation part 600.

The increase in the heat content of the working fluid flowing into the compressor 400 may increase the heat exchange efficiency of the heat exchanger 300.

Meanwhile, in order to increase the amount of working fluid that is introduced into the compressor 400, it is necessary to increase the area of the entrance 862 of the extraction line. To this end, for example, the area of the entrance 862 of the extraction line may be formed to be larger than the cross-sectional area of the flow path of another portion of the second pipe 864.

Alternatively, the entrance 862 of the extraction line may be provided in plural in order to increase the area of the entrance 862 of the extraction line. This will be described in detail with reference to FIGS. 13 and 14.

Figure 13:
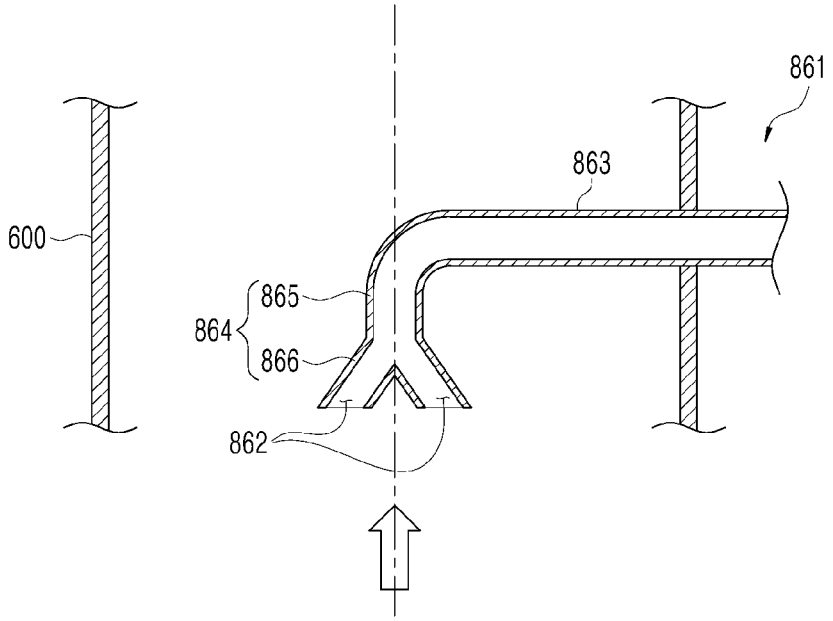
FIG. 13 is a diagram for explaining the internal structure of an accommodation part according to still another embodiment.
Figure 14:
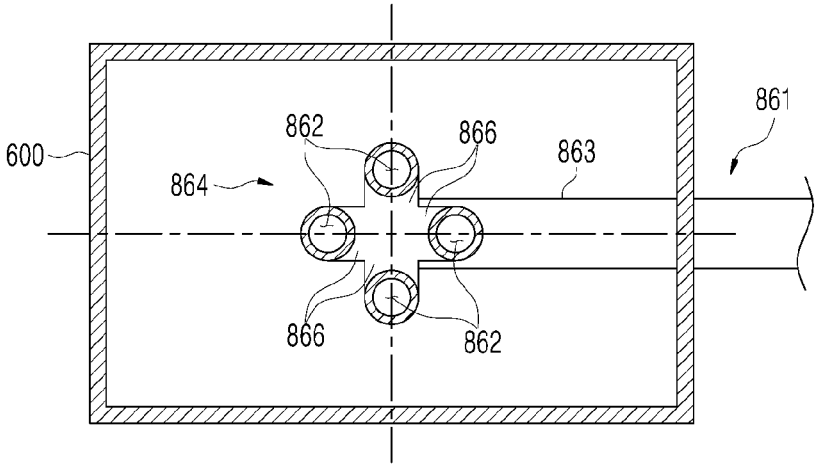
FIG. 14 is a diagram of the structure of FIG. 13 rotated by 90°.

FIG. 13 is a diagram for explaining the internal structure of an accommodation part 600 according to still another embodiment. FIG. 14 is a diagram of the structure of FIG. 13 rotated by 90°. The extraction line is illustrated in FIGS. 13 and 14 as having four entrances 862. However, in some embodiments, the extraction line may have two, three, or five or more entrances 862.

Although the extraction line is illustrated in the cross-sectional diagram of FIG. 13 as having two entrances 862, the embodiment shown in FIGS. 13 and 14 may be configured such that the extraction line has four entrances 862, as shown in FIG. 14.

In the dryer, a plurality of entrances 862 of the extraction line may be provided at the center portion inside the accommodation part 600, and the entrances 862 of the extraction line may be disposed so as to be symmetrical to each other.

In this case, the second pipe 864 may include a header 865 and a branch line 866.

The header 865 may be connected at one end thereof to the first pipe 863, and may be bent and extend from the first pipe 863. The header 865 may be formed such that the longitudinal direction thereof is parallel to the flow direction of the working fluid in the accommodation part 600.

The branch line 866 may be provided in plural. One end of each of the branch lines may be connected to the header 865, and each of the entrances 862 of the extraction line may be formed in the other end of a respective one of the branch lines.

Due to this structure, since the entrance 862 of the extraction line is provided in plural, the total cross-sectional area of the entrances 862 of the extraction line may increase, and accordingly, the amount of working fluid that is introduced into the compressor 400 may increase.

In addition, the plurality of entrances 862 of the extraction line may be disposed such that the center thereof is aligned with the center of the cross-section of the accommodation part 600, and may be disposed so as to be symmetrical to each other with respect to the center of the header 865. Due to this structure, all of the entrances 862 of the extraction line may be disposed at the center portion of the cross-section of the accommodation part 600.

According to the embodiment, even when the entrance 862 of the extraction line is provided in plural, a portion of the working fluid that has a relatively high temperature and contains a relatively large amount of steam in the accommodation part 600 may be introduced into the compressor 400 through the entrances 862 of the extraction line, and accordingly, the heat exchange efficiency of the heat exchanger 300 may increase.

As described above, the working fluid in the circulation line 850 is heated by the heat exchanger 300, and is introduced into the tumbler 100 to heat the object to be dried accommodated in the tumbler 100, thereby drying the object to be dried.

After operation of the dryer commences, it is necessary to quickly heat the object to be dried in the initial stage of a drying operation in order to quickly and efficiently perform the drying operation. This initial heating serves to heat the working fluid in the circulation line 850. In order to implement initial heating, a heating device 500 may be provided in the circulation line 850.

During initial heating, the object to be dried in the tumbler 100 is continuously heated, and accordingly, the water contained in the object to be dried continues to evaporate, so the working fluid in the circulation line 850 and the working fluid in the non-circulation line 860 contain a sufficient amount of steam. Thereby, heat exchange may be smoothly performed in the heat exchanger 300, and at this time initial heating may be terminated.

For example, the time period required for initial heating may be set in consideration of the specifications of the dryer, and initial heating may be terminated when the set time period elapses.

The heating device 500 may be provided in the tumbler 100. That is, the tumbler 100 may be provided therein with the heating device 500 for heating the object to be dried received therein.

In order to implement initial heating rapidly and efficiently, it is appropriate for the heating device 500 to be disposed at a position at which steam is secured most efficiently through heating. This position may be the tumbler 100, in which a wet object to be dried is received.

Therefore, according to the embodiment, since the heating device 500 is provided in the tumbler 100 in order to heat the inside of the tumbler 100, it is possible to obtain a large amount of steam in a short time period with a small amount of heat compared to the case in which the heating device 500 is disposed at another position in the dryer.

The dryer may further include a heater controller 1000 and a humidity sensor HS in addition to the heating device 500.

The heater controller 1000 may be electrically connected to the heating device 500, and may control the operation of the heating device 500. The heater controller 1000 may be electrically connected to the controller 900, and the controller 900 may control the heater controller 1000 in order to control the operation of the heating device 500.

The humidity sensor HS may be electrically connected to the heater controller 1000, and may be mounted in the tumbler 100 to measure the humidity in the tumbler 100.

The heater controller 1000 may operate the heating device 500, may measure the humidity of the working fluid using the humidity sensor HS, and may stop the operation of the heating device 500 when the humidity reaches a predetermined range, thereby terminating initial heating.

The heating device 500 may be disposed at a position adjacent to the inner surface of the tumbler 100. Due to this structure, the heating device 500 may quickly heat the object to be dried received in the tumbler 100 with a small amount of heat, thereby rapidly securing the necessary steam.

The heating device 500 may be configured as, for example, an electric induction heater. In the case of an electric induction heater, a heat-emitting part may be formed in a plate shape, and thus may be easily mounted on the inner surface of the tumbler 100.

Therefore, as shown in FIG. 11, at least part of the electric induction heater, for example, a heat-emitting part, may be disposed on the inner surface of the tumbler 100 in the circumferential direction. In this case, the heat-emitting part of the electric induction heater may be configured as a single plate, and may be disposed on the inner surface of the tumbler 100 in the circumferential direction. Alternatively, the heat-emitting part of the electric induction heater may be composed of multiple plates, and the multiple plates may be disposed at predetermined intervals on the inner surface of the tumbler 100 in the circumferential direction. In this case, the heat-emitting part of the electric induction heater may be provided so as to rotate together with the tumbler 100.

Figure 15:
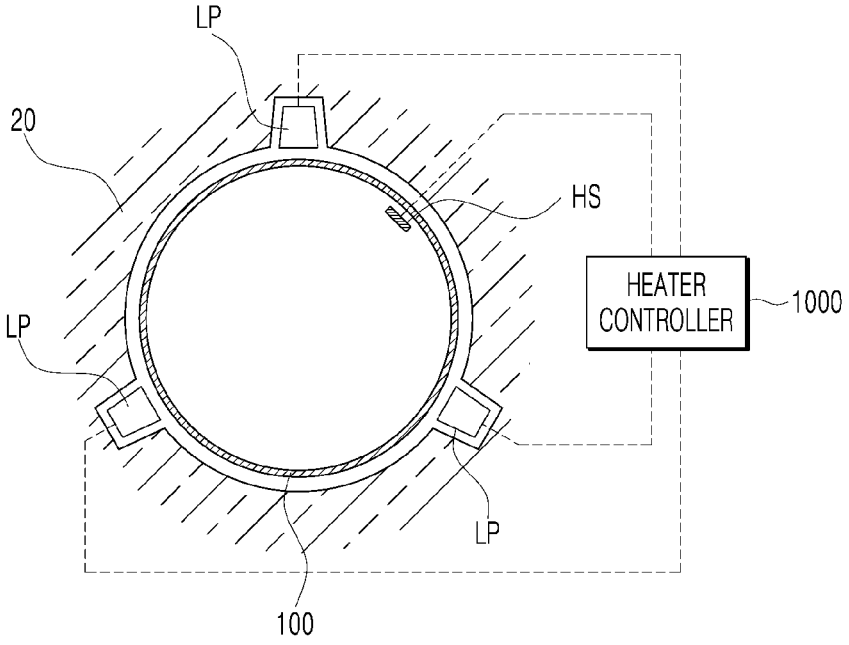
FIG. 15 is a diagram for explaining the structure of a heating device according to still another embodiment.

FIG. 15 is a diagram for explaining the structure of a heating device 500 according to still another embodiment. As shown in FIG. 15, the heating device 500 may be configured as an infrared lamp LP. In this case, at least one infrared lamp LP may be disposed outside the tumbler 100 in the circumferential direction.

As shown in FIG. 15, the infrared lamp LP may be provided in plural. The infrared lamps LP may be disposed at regular intervals in the circumferential direction of the tumbler 100, and may be electrically connected to the heater controller 1000.

Because the infrared lamp LP has a relatively large volume, the infrared lamp LP may be provided in the dryer so as to be fixed to the body 20 of the dryer, rather than being rotatable.

For example, a recess may be formed in the body 20 of the dryer, in which the tumbler 100 is mounted, and the infrared lamp LP may be disposed in the recess. In this case, the portion of the wall surface of the tumbler 100 that faces the infrared lamp LP may be formed of a transparent material so that infrared radiation passes through the wall surface of the tumbler 100 and heats the object to be dried received in the tumbler 100.

The present disclosure described as above is not limited by the aspects described herein and accompanying drawings. It should be apparent to those skilled in the art that various substitutions, changes, and modifications that are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

MODE(S) FOR CARRYING OUT THE INVENTION

Many modifications to the above embodiments may be made without altering the nature of the invention. The dimensions and shapes of the components and the construction materials may be modified for particular circumstances. While various embodiments have been described above, it should be understood that they have been presented by way of example only, and not as limitations.

INDUSTRIAL APPLICABILITY

According to the dryer operating method according to the present disclosure, since initial heating using the heating device and reduction of the pressure in the tumbler using the compressor are performed together, the proportion of steam in the circulation line may reach or exceed a predetermined value. As such, since the present disclosure overcomes the limits of existing technology, the present disclosure is not only useful in the field discussed herein, but also increases the marketability and business potential of apparatuses to which the present disclosure is applicable, and can be practically and explicitly implemented. Accordingly, the present disclosure has industrial applicability.

The invention claimed is:

1. A method for operating a dryer, the dryer including a heating device, a tumbler that is configured to receive an object to be dried and that is connected to an exit of the heating device, a fan connected to an exit of the tumbler, a heat exchanger connected to an exit of the fan through a first flow line that is configured to carry a working fluid, a compressor having (i) an entrance connected to a circulation line including the first flow line connected to the exit of the fan and (ii) an exit connected to an entrance of the heat exchanger, a discharge valve connected to an exit of the heat exchanger, a discharge line connected to the exit of the heat exchanger and to the discharge valve, a regeneration line that is branched from the discharge line and connected to the circulation line, and a control valve disposed at the regeneration line, the method comprising:

operating the heating device to thereby heat the working fluid;

based on operating compressor, discharging a portion of the working fluid in the circulation line to an outside of the circulation line to thereby reduce a pressure of the working fluid in the tumbler;

operating the tumbler to thereby dry the object in the tumbler;

operating the control valve to control flow of the working fluid from the regeneration line to the circulation line; and cooling the object in the tumbler.

2. The method according to claim 1, further comprising performing heat exchange through the heat exchanger that is accommodated in an accommodation duct, wherein the accommodation duct is connected to (i) the first flow line connected to the exit of the fan, (ii) a second flow line that is connected to an entrance of the heating device, and (iii) a third flow line that is connected to an entrance of the compressor.

3. The method according to claim 1, further comprising:

opening the discharge valve based on a decrease of the pressure in the tumbler; and closing the discharge valve based on operating the tumbler to dry the object in the tumbler.

4. The method according to claim 1, further comprising communicating the working fluid through the regeneration line to at least one of:

a first part of the circulation line that connects the heating device to the tumbler, a second part of the circulation line that connects the tumbler to the fan, a third part of the circulation line that is connected to the exit of the fan, or a fourth part of the circulation line that is connected to an entrance of the heating device.

5. The method according to claim 1, further comprising:

closing the control valve based on a decrease of the pressure in the tumbler; and opening the control valve based operating the tumbler to dry the object in the tumbler.

6. The method according to claim 1, further comprising communicating the working fluid through a plurality of elements of the dryer that comprise:

a gas-liquid separator having (i) an entrance connected to the exit of the heat exchanger, (ii) a gas exit connected to the regeneration line, and (iii) a condensed water exit;

a steam trap connected to the condensed water exit of the gas-liquid separator;

a decompression device disposed at at least one of (i) a flow line that connects the exit of the heat exchanger to the entrance of the gas-liquid separator or (ii) a flow line that connects the gas exit of the gas-liquid separator to the discharge line;

a first bypass line that has two ends connected to respective ends of the decompression device;

a first bypass valve disposed at the first bypass line;

a second bypass line that has two ends connected to respective ends of the steam trap; and a second bypass valve disposed at the second bypass line.

7. The method according to claim 1, further comprising:

stopping operation of the heating device based on a decrease of the pressure in the tumbler.

8. The method according to claim 1, further comprising:

supplying at least a portion of the working fluid discharged from the heat exchanger into the circulation line based on operating the tumbler to dry the object in the tumbler.

9. The method according to claim 1, further comprising:

stopping operation of the compressor based on the object in the tumbler being cooled.

10. The method according to claim 1, further comprising communicating the working fluid through the heat exchanger that comprises:

a first inlet configured to receive the working fluid from the compressor; and a first outlet configured to discharge the working fluid from the heat exchanger, wherein the first inlet is disposed at a higher position than the first outlet.

11. The method according to claim 10, wherein communicating the working fluid through the heat exchanger further is performed through:

a first header that extends an upward-downward direction and defines the first inlet;

a second header that is spaced apart from the second header in a horizontal direction and extends in the upward-downward direction, the second header defining the first outlet; and a plurality of first tubes that connect the first header to the second header and are spaced apart from one another by predetermined intervals in the upward-downward direction, each of the plurality of first tubes having two ends that are connected to the first header and the second header, respectively.

12. The method according to claim 10, wherein communicating the working fluid through the heat exchanger is performed through:

a plurality of tubes that are spaced apart from one another by predetermined intervals in an upward-downward direction; and a plurality of return bands, each of the plurality of return bands connecting an exit of one of the plurality of tubes to an entrance of an adjacent one of the plurality of tubes, and wherein the plurality of tubes comprises:

a top tube that is disposed at an uppermost position among the plurality of tubes in the upward-downward direction, the top tube defining the first inlet, and a bottom tube that is disposed at a lowermost position among the plurality of tubes in the upward-downward direction, the bottom tube defining the first outlet.

13. The method according to claim 12, wherein communicating the working fluid through the heat exchanger is performed through the plurality of tubes and the plurality of return bands that define a single flow path of the heat exchanger from the first inlet to the first outlet.

14. The method according to claim 1, further comprising communicating the working fluid through an extraction line that is branched from the circulation line and connected to the entrance of the heat exchanger, wherein an entrance of the extraction line is configured to face the working fluid carried by the circulation line.

15. The method according to claim 14, further comprising performing heat exchange through the heat exchanger that is accommodated in an accommodation duct configured to carry the working fluid, wherein the entrance of the extraction line is disposed at a center portion of the accommodation duct and configured to receive the working fluid that enters the accommodation duct in a direction perpendicular to a cross-sectional surface of the accommodation duct.

16. The method according to claim 15, further comprising communicating the working fluid through the extraction line that comprises:

a first pipe that passes through a wall of the accommodation duct, the first pipe having a first end connected to the compressor and a second end disposed inside the accommodation duct; and a second pipe that is curved and extends from the second end of the first pipe, the second pipe extending in a longitudinal direction parallel to a flow direction of the working fluid in the accommodation duct, and wherein an end of the second pipe defines the entrance of the extraction line.

17. The method according to claim 16, wherein communicating the working fluid through the extraction line is performed through the second pipe that comprises:

a header having one end connected to the first pipe; and a plurality of branch lines that are branched from the header, and wherein each of the plurality of branch lines has one end that is connected to the header and another end that defines the entrance of the extraction line.

* * * * *